US012611049B2

(12) United States Patent
Dacks et al.

(10) Patent No.: US 12,611,049 B2
(45) Date of Patent: Apr. 28, 2026

(54) BREATHABLE CRIB

(71) Applicant: Halo Dream, Inc., New York, NY (US)

(72) Inventors: Rachel Dacks, Savannah, GA (US); Darrell L. Vincent, Bristol, RI (US)

(73) Assignee: Halo Dream, Inc., New York, NY (US)

( * ) Notice: Subject to any disclaimer, the term of this patent is extended or adjusted under 35 U.S.C. 154(b) by 0 days.

(21) Appl. No.: 18/771,717

(22) Filed: Jul. 12, 2024

(65) Prior Publication Data

US 2025/0072632 A1 Mar. 6, 2025

Related U.S. Application Data

(63) Continuation of application No. 17/246,153, filed on Apr. 30, 2021, now Pat. No. 12,035,818, which is a continuation-in-part of application No. PCT/US2020/051433, filed on Sep. 18, 2020, which is a continuation of application No. 16/575,225, filed on Sep. 18, 2019, now abandoned, said application No. 17/246,153 is a continuation-in-part of application No. 16/130,548, filed on Sep. 13, 2018, now abandoned.

(60) Provisional application No. 62/557,867, filed on Sep. 13, 2017.

(51) Int. Cl.
*A47D 7/03* (2006.01)
*A47D 9/00* (2006.01)

(52) U.S. Cl.
CPC ..... *A47D 7/03* (2013.01); *A47D 9/00* (2013.01)

(58) Field of Classification Search
CPC ..... A47C 21/046; A47C 21/08; A47D 7/00; A47D 9/00; A47D 15/005
See application file for complete search history.

(56) References Cited

U.S. PATENT DOCUMENTS

| | | | | |
|---|---|---|---|---|
| 6,256,813 | B1 | 7/2001 | Aaron | |
| 12,035,818 | B2 | 7/2024 | Dacks et al. | |
| 2004/0154099 | A1* | 8/2004 | Waters | A47G 9/10 5/655 |
| 2006/0225207 | A1 | 10/2006 | Johnson | |
| 2011/0258776 | A1* | 10/2011 | Schwartz | A47D 7/02 5/100 |

(Continued)

FOREIGN PATENT DOCUMENTS

| | | | |
|---|---|---|---|
| WO | 2016130361 | 8/2016 | |
| WO | WO-2016130361 A1 * | 8/2016 | A47D 15/008 |

*Primary Examiner* — Adam C Ortiz
(74) *Attorney, Agent, or Firm* — Merchant & Gould P.C.

(57) ABSTRACT

In general a crib includes a first and second side that each have a first perimeter support having a bottom support portion, a first breathable material retained by the perimeter support, and a lateral support member that further supports the breathable material in a position within the perimeter support and attached to the perimeter support. The crib also includes third and fourth sides, wherein the first, second, third and fourth sides define an interior. The crib further includes a mattress support platform positioned in the interior and movable between a first position proximate the lateral support member and a second, lower position proximate the bottom portion of the perimeter support. The breathable material has an air permeability of between 385 CFM to 1530 CFM and a light permeability of between 47 and 99%.

20 Claims, 30 Drawing Sheets

(56) References Cited

U.S. PATENT DOCUMENTS

| | | | |
|---|---|---|---|
| 2012/0030879 | A1 | 2/2012 | Waters et al. |
| 2013/0212804 | A1 | 8/2013 | Petrucci |
| 2015/0033473 | A1 | 2/2015 | Wu |
| 2017/0251827 | A1 | 9/2017 | Gallina |
| 2019/0246802 | A1 | 8/2019 | Dacks et al. |
| 2021/0076839 | A1 | 3/2021 | Dacks et al. |

* cited by examiner

BREATHABLE CRIB

CROSS-REFERENCE TO RELATED APPLICATIONS

The present application is a Continuation of U.S. patent application Ser. No. 17/246,153, filed 30 Apr. 2021, which is a Continuation-in-Part of International Patent Application No. PCT/US2020/051433, filed 18 Sep. 2020, which is a Continuation of U.S. patent application Ser. No. 16/575,225, filed on 18 Sep. 2019; U.S. patent application Ser. No. 17/246,153 is also a Continuation-in-Part of U.S. application Ser. No. 16/130,548, filed on 13 Sep. 2018, which claims the benefit of U.S. Provisional Application No. 62/557,867, filed on 13 Sep. 2017. A claim of priority to all, to the extent appropriate, is made.

TECHNICAL FIELD

The present invention relates to cribs and other usable objects (e.g., child or infant objects). More particularly, the present invention pertains to a safer crib design that includes breathable sides, for example, that protect infants or young children from harm, such as, getting limbs extended and caught between crib slats. In addition, such can allow air to flow into, out of or around the interior of the crib.

BACKGROUND

Conventional baby cribs typically include side rails that are made up of top and bottom horizontal bars interconnected by a series of spaced vertical supports (e.g., vertical slats). Frequently, babies and toddlers, while sleeping or playing in their cribs, intentionally or accidentally extend their limbs out of the crib between the slats and have difficulty drawing them back into the crib. If this occurs when the child is sleeping, the extended limbs will remain uncovered and become cold, and the child will be ultimately awakened or harmed. Many cribs also have headboards and footboards (i.e., end boards) that are also made with spaced-apart supports and the baby may also extend its arms or legs out of the crib between these slats.

Although various types of apparatus have been used to prevent such problematic situations (e.g., extension of limbs outside of the crib through the spaced-apart supports), many of such apparatus exhibit their own problems. For example, as described herein, ventilation may be problematic (e.g., such as that leading up to and resulting in suffocation). For example, crib bumpers are widely used in cribs for protecting a child from injury caused by bodily impact of the child against the sides of the crib that define the interior boundary of the crib. However, in many cases, such bumpers do not allow for adequate ventilation, or air flow, within the crib and also obstruct viewing of the child.

Infants usually breathe through their nasal passages. However, during crying or in the event their nasal passages are blocked, infants may breathe through their oral cavities. Mechanical resistance suffocation takes place when respiration is interrupted if these passages are both blocked externally by an object. When respiration is interrupted, $CO_2$ levels in the blood rise. The body's response to this elevation in $CO_2$ levels is to attempt more rigorous respiration. If suffocation is not removed, the incident may be fatal after two or three minutes. Further, the accumulation of $CO_2$ or other dangerous gases inside the crib or around the infant may be a possible cause of sudden infant death syndrome (SIDS). Existing crib apparatus, such as crib bumpers, tend to trap dangerous gases inside the crib. Further, such apparatus may block the passages of infants under certain circumstances. Therefore, improvements are desirable.

Various types of other crib apparatus have been described and attempt to reduce one or more of the above problems. For example, such apparatus are described in U.S. Pat. No. 5,881,408 to Bashista et al., entitled "Mesh Crib Liner," issued 16 Mar. 1999; and U.S. Pat. No. 6,178,573 to Wagner et al., entitled "Ventilation Upgrade Kit for a Crib Bumper and Method of Using It."

SUMMARY OF THE INVENTION

The present invention, as described herein, addresses the problems described above and other problems of prior art systems and methods that will become apparent to one skilled in the art from the description below. In general a crib includes a first and second side that each have a first perimeter support having a bottom support portion, a first breathable material retained by the perimeter support, and a lateral support member that further supports the breathable material in a position within the perimeter support and attached to the perimeter support. The crib also includes third and fourth sides, wherein the first, second, third and fourth sides define an interior. The crib further includes a mattress support platform positioned in the interior and movable between a first position proximate the lateral support member and a second, lower position proximate the bottom portion of the perimeter support. The breathable material has an air permeability of between 385 CFM to 1530 CFM and a light permeability of between 47 and 99%. In another example a crib includes first and second sides and third and fourth sides that each include a top support fixedly attached to the first and second sides and a bottom support movably attached to the first and second sides, a first breathable material retained by the top support and the bottom support and the breathable material forming a sling for retention of a mattress support platform. The mattress support platform is movable to various positions by moving the bottom support member and wherein the sling also moves such that the breathable material moves up and down to enclose the space above the mattress support platform.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION OF THE EMBODIMENTS

Figure 1A:
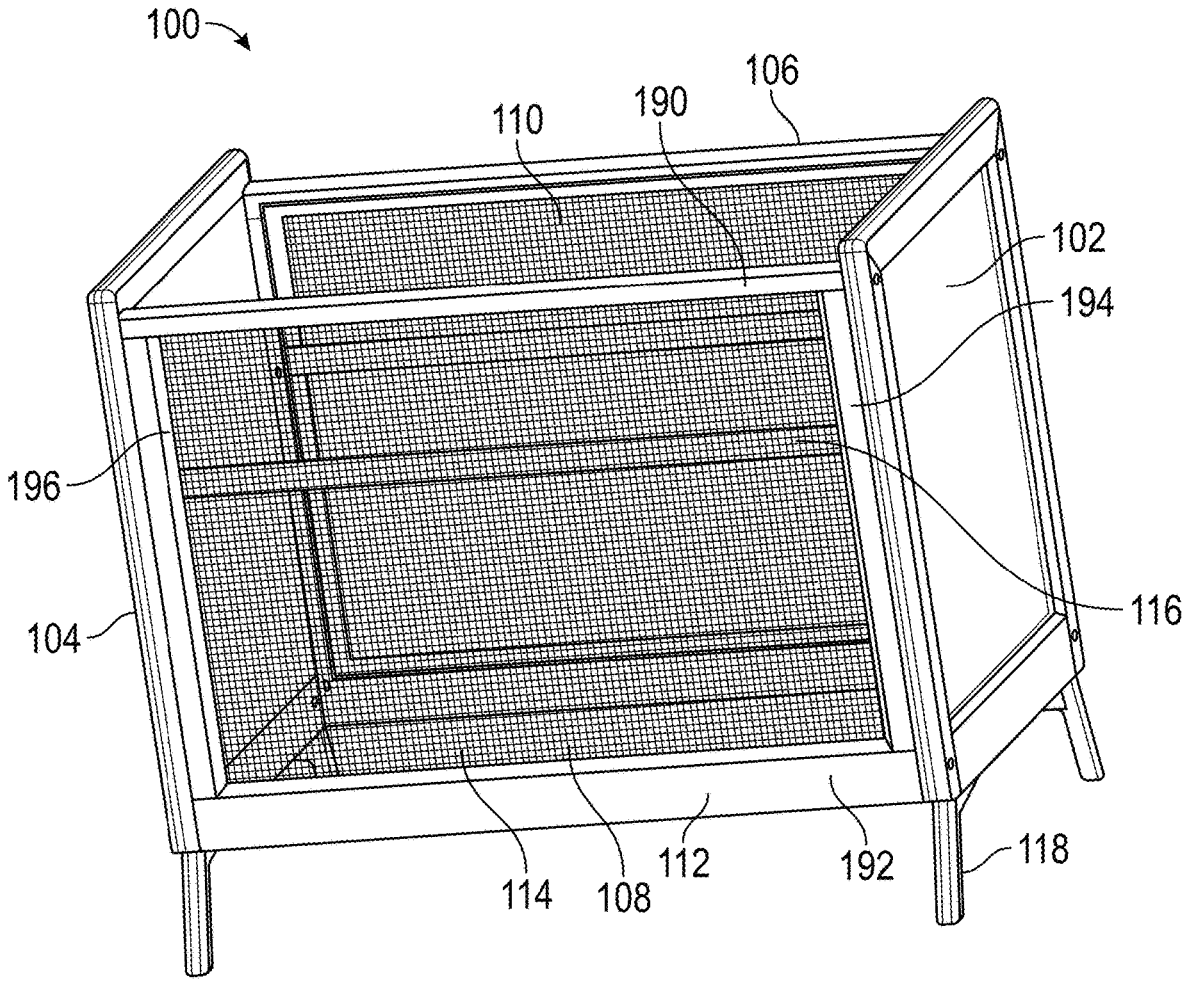
FIG. 1A shows a perspective view of one embodiment of a crib, according to one example embodiment of the present invention.

Various embodiments of breathable cribs shall be described with reference to FIGS. 1-23 and the below description. The particular features of the disclosed embodiments should not be limited to just those illustrated configurations. Instead, the various features disclosed within this disclosure may be combined to create exponentially more embodiments not explicitly illustrated within this disclosure. For example, the various fastener apparatus and configurations for attaching the components to a crib disclosed within may be combined in far more configurations than illustrated within the confines of this disclosure. Further, some exemplary embodiments are illustrated as one panel embodiments while other exemplary embodiments are illustrated as two panel embodiments. It should be understood that the features of such illustrated one panel embodiments and illustrated two panel embodiments (e.g., size, shape, fastener arrangement, method of attaching to crib, etc.) may be interchanged and/or combined to form exponentially more embodiments not explicitly illustrated within this disclosure. As such, the claims should not be limited only to such exemplary illustrated embodiments. Additionally, breathable or airflow material not only includes mesh material and padded mesh material, but may also include alternate material(s) that have similar airflow and/or padding properties (e.g., the weave found in cotton sweaters, such as a corded cotton sweater, may be sufficiently padded and breathable).

In general, the present invention is related to a crib design having at least two breathable sides and having a mattress support movable between at least two positions within the crib interior. In general, the American Academy of Pediatrics ("AAP") now recommends that infants sleep in the parents' room, close to the parents' bed, but on a separate surface designed for infants, ideally for the first year of life, but at least for the first 6 months. Currently, 3,500 infants die annually in the United States from sleep-related deaths, including sudden infant death syndrome (SIDS). The AAP states that sharing a room could cut babies' chance of dying in their sleep by up to 50 percent. The present invention provides a single solution for the first full year room sharing that makes it easier and thus more likely that the infant will sleep in the parents' room. The present invention is different from existing solutions. The present invention is stronger than other soft-sided solutions and has breathable sides that protect the infant's limbs from entrapment and define a safe sleep environment.

A crib in accordance with the teachings herein may include at least one side comprised of a functional fabric. The functional fabric may be, for example a breathable fabric and having characteristics of air permeability, light permeability, CO2 rebreathing, and/or other functional characteristics.

Air permeability is the measure of air flow passed through a given area of a fabric. Air permeability is defined as the flow rate of air per unit area at a given differential pressure and may be expressed as cubic feet per minute, CFM. In the context of a crib, air permeability quantifies the resistance of a material to allow a baby to breathe the air on the contralateral side of the material. Air permeability may be influenced by thickness of material, density of material, and the material construction.

Light permeability, sometimes referred to as light transmission, may be defined as the percentage of light that passes through the fabric from a first side to a second side.

Carbon dioxide ($CO_2$) is the gas the body naturally produces as waste. Humans breathe in oxygen ($O_2$) and breathe out $CO_2$. When someone rebreathes $CO_2$, that is, when they inhale the exhaled $CO_2$, it can have harmful effects on the body. $CO_2$ rebreathing (also referred to as $CO_2$RB) can be measured and used as a metric for quantifying impaired respiration. The $CO_2$ rebreathing value is the percentage of $CO_2$ contained in a unit of air that is rebreathed.

The $CO_2$ rebreathing value may be influenced by the tendency for $CO_2$ to become retained within the fibers of the material. This in turn may sometimes be related to the air permeability of the material. Accordingly, in some embodiments, a crib may be provided having at least one side having a high air permeability and a low $CO_2$ rebreathing value. A mesh material may be useful by also limiting the influence of force (the pressure of an infant's head) against the material to $CO_2$ pushed into material. That is, the level of $CO_2$ rebreathing may be largely unchanged with increased force using certain mesh materials. This is thought to result from the lack of effective seal made between the infant's face and the mesh material. Accordingly, a crib as disclosed herein may maintain a stable low $CO_2$ rebreathing value independent of applied force.

The crib is designed to have breathable sides wherein the breathable sides have structural integrity to prevent bowing out and creating an entrapment hazard or tearing of the fabric. In some embodiments, this is done by providing a lateral support member. In other embodiments, structural support may be built into the breathable material, for example by adding a functional threading through the material. In some embodiments, a mattress may be provided within the crib and movable between two or more positions.

Referring to FIG. 1A, a crib 100 is generally shown. The crib includes a first side 102, a second side 104, a third side 106 and a fourth side 108. Preferably, the third side 106 and fourth side 108 are wider than the first side 102 and second side 104, such that the four sides 102, 104, 106, 108 define a generally rectangular interior space 110. In the embodiment of FIG. 1A, the first side 102 and second side 104 are of solid construction for aesthetic reasons, structural support and to prevent entrapment of the infants' limbs. Of course, one of ordinary skill in the art would recognize that alternative designs are also possible. For example, referring to FIG. 1B, in another example embodiment, a crib 200 is generally shown. In this embodiment, a first side 202 and second side 204 are of open construction. Further, it is to be appreciated that while a four sided crib is shown, cribs in accordance with the teachings herein may have a different number of sides. For example, a round crib may be provided.

Preferably, the fourth side 108 includes a perimeter structural support system 112 that surrounds and supports a breathable material 114. The perimeter structural support system having a top portion 190, a bottom portion 192 and first and second side portions 194, 196. The breathable material 114 can be any material that allows air to flow through it, including a mesh like material or an open weave fabric. The breathable material 114 also allows the crib sides to be see-through or at least partially transparent so that an infant inside the crib can be viewed through the material. Preferably, the breathable material 114 has an air permeability of between 385 CFM to 1530 CFM and a light permeability of between 47 and 99%, and a CO2 rebreathing value of less than 20%. In some embodiments, the breathable material may comprise a mesh-type material having a mesh coverage of between 32% and 91%.

The fourth side 108 also includes a lateral support member 116. The lateral support member 116 helps retain the breathable material 114 in position and keep it from bowing out if the infant comes in contact with it. The lateral support member 116 can be placed either inside of the crib 100 or preferably outside of the crib 100. In some embodiments, more than one lateral support member may be provided. The lateral support member 116 can be any solid material (i.e. wooden, metal, plastic or the like) or a soft material (i.e. hook and loop, zipper or the like). The third side 106 can include similar construction to that of the fourth side 108.

The crib 100 further may include legs 118 that support the crib 100. As shown in FIG. 1A, the legs 118 may be angled toward the outsides of the crib to create additional lateral stability for the crib 100. One of ordinary skill in the art would also recognize that other legs designs are possible. Furthermore, the legs 118 could include casters, rollers, felt pads or other devices to enable the crib to be more easily moved about.

Figure 2:
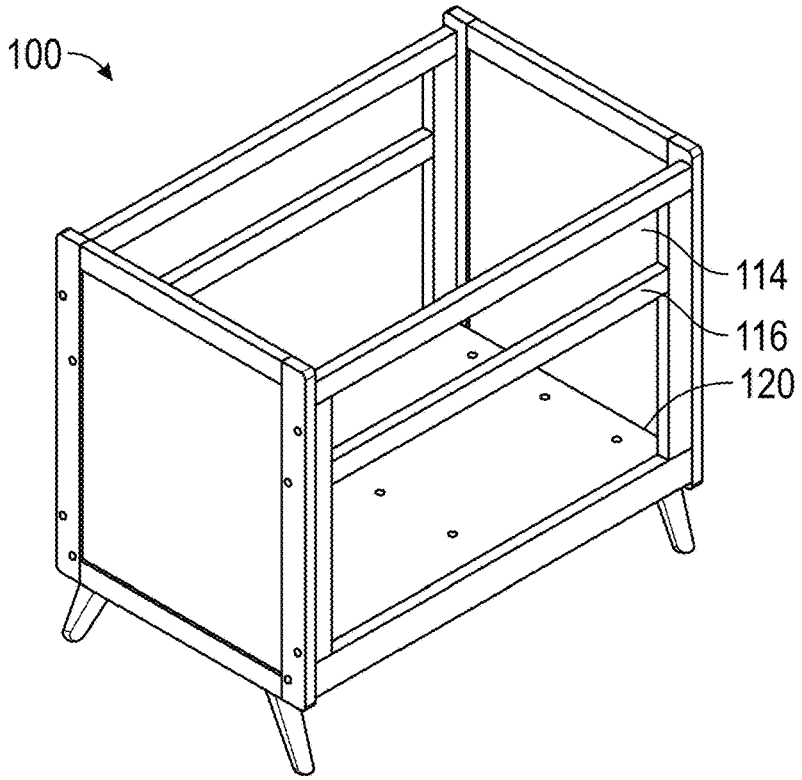
FIG. 2 shows another perspective view of the crib of FIG. 1A with the mattress support illustrated in a lower position, according to an example embodiment of the present invention.
Figure 3:
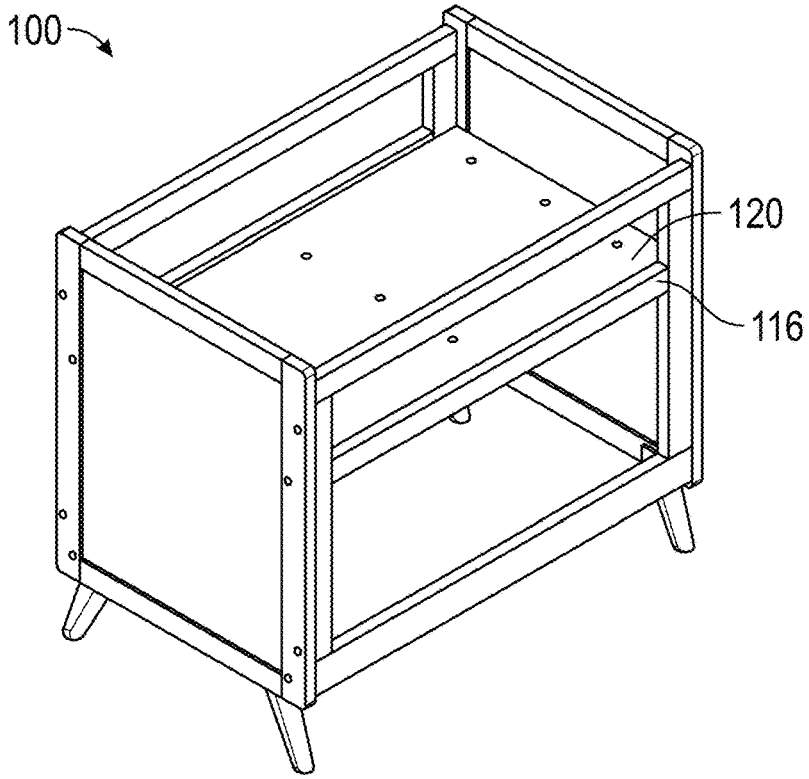
FIG. 3 shows another perspective view of the crib of FIG. 1A with the mattress support illustrated in an upper position, according to an example embodiment of the present invention.
Figure 37:
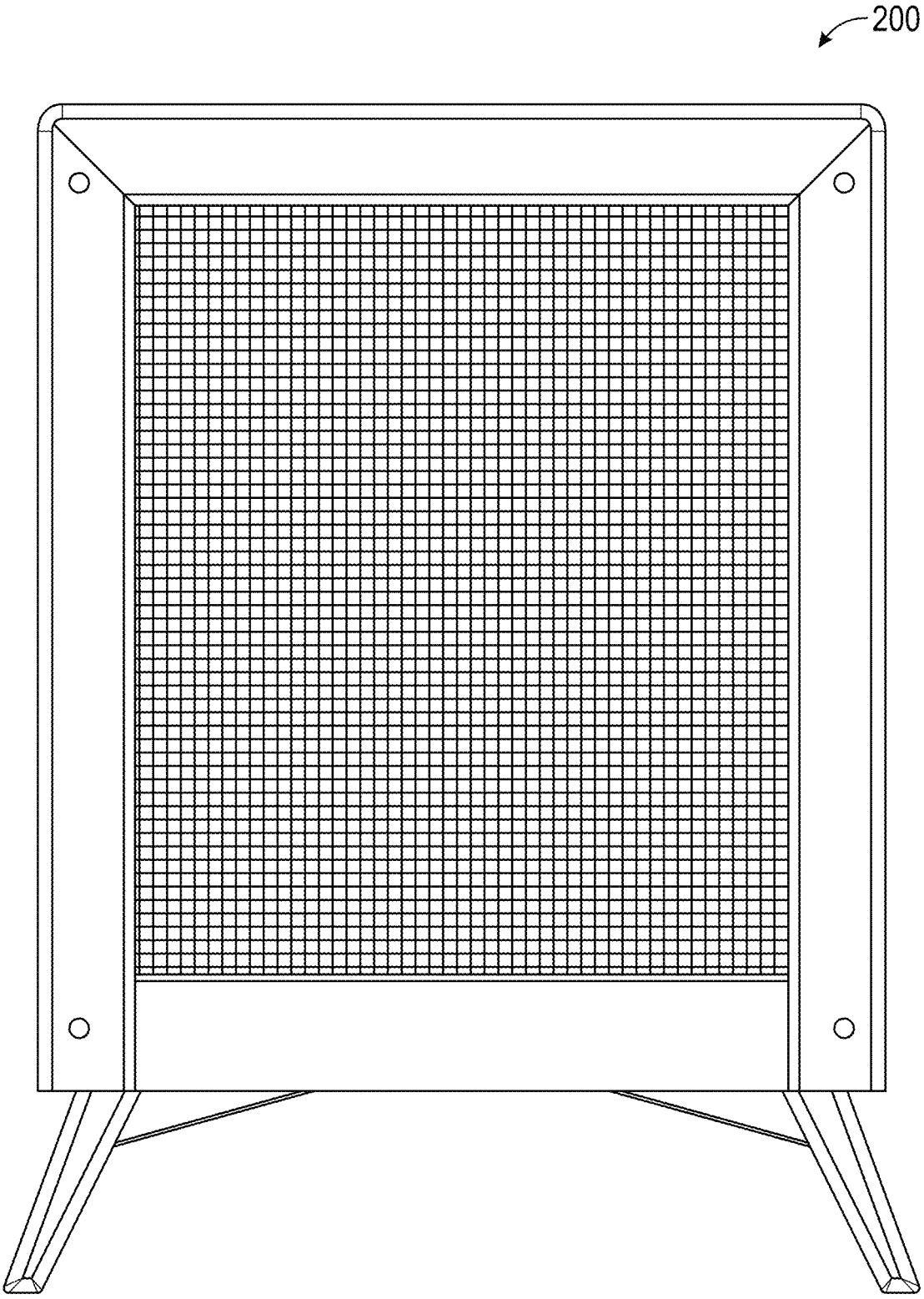
FIG. 37 shows a left and right side view having a breathable material, according to another example embodiment of the crib of FIG. 1B.
Figure 38:
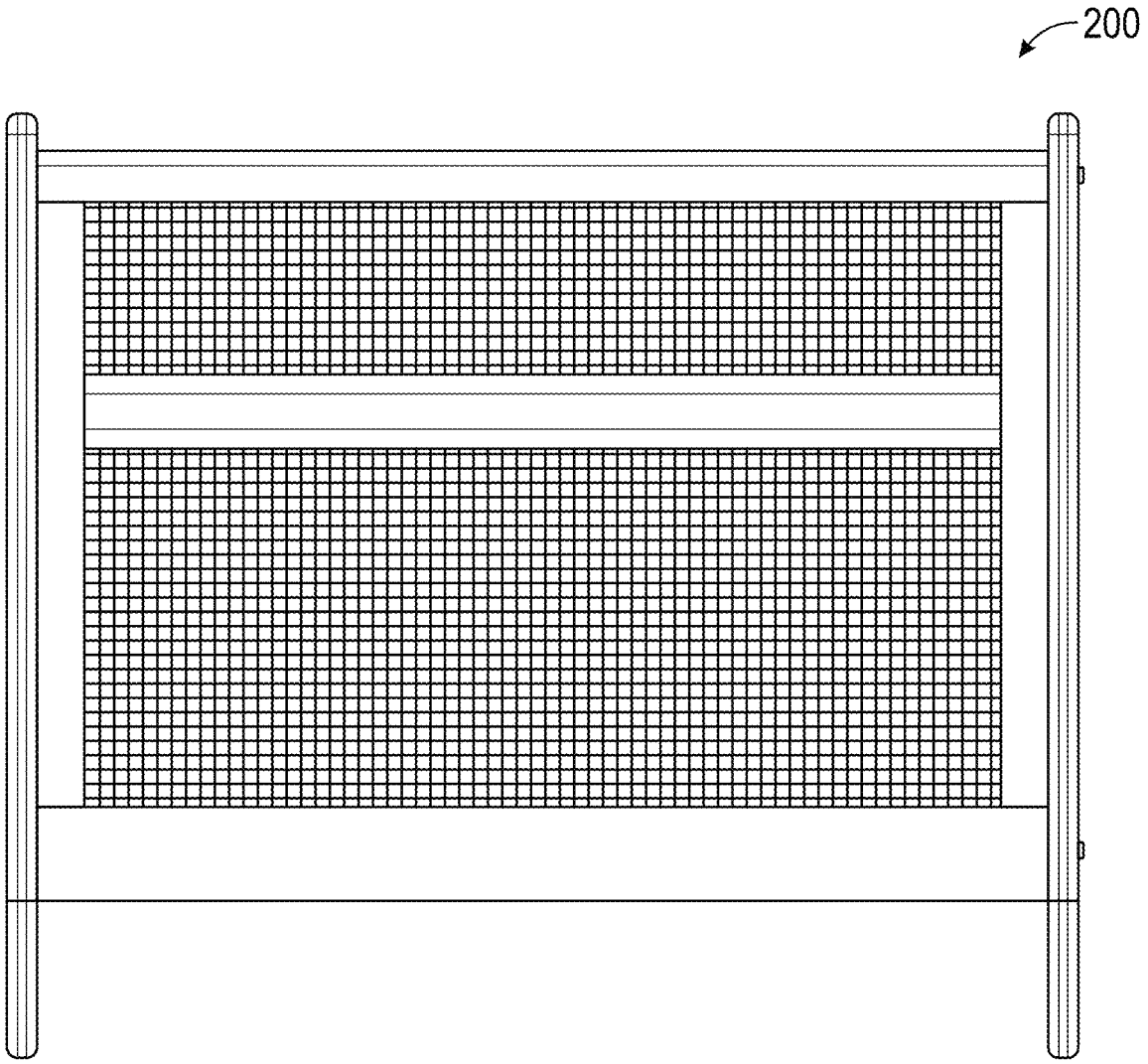
FIG. 38 shows a front/back view having a breathable material, according to another example embodiment of the crib of FIG. 1B.

FIG. 2 illustrates the crib 100 with a lateral support member 116 positioned outside of the breathable material 114 (for illustrative purposes, the breathable material is not shown in FIGS. 2 and 3 but is visible, for example, in FIGS. 37 and 38). The crib 100 further includes a mattress platform 120. In FIG. 2, the mattress platform 120 is positioned in the "mini crib" position, which is lower in the crib 100 for when the infant grows to help prevent the infant from climbing or falling out of the crib 100. In this lower position, the mattress platform 120 is proximate the bottom portion 192 of the perimeter support 112. In this position, the lateral support member 116 is approximately 16" above the top of the mattress platform 120 to prevent the chance of the lateral support member 116 being used as a toehold for climbing out by the child. The lateral support member 116 can either be stationary or adjustable to coordinate with multiple platform height adjustments.

The mattress platform 120 is secured to at least two of the four sides 102, 104, 106, 108 of the crib 100 using any suitable means such as screws, pins, nails or other fastening devices. The mattress platform 120 is movable to at least one other position as shown in FIG. 3 and retained in this position by any suitable means. This raised position is similar to the depth of a bassinet for use when the infant is newborn and up and until the infant begins to push up on hands and knees. This position makes it easier for the parents to reach the infant without bending over more than necessary and to align the infants sleep position with the parents' sleep position for better visual monitoring and foster emotional connection. In this position, the mattress platform 120 is approximately at the same height of the lateral support member 116.

The lateral support member 116 prevents the breathable material 114 from bowing and allowing the infant to fall through, tear the breathable material, or otherwise compromise the integrity of the crib. The breathable material 114 is enclosed between the mattress platform 120 and the lateral support member 116 to prevent the outward deflection of the breathable material 114 away from the mattress platform 120 at an area where an infant rolling or pushing against the breathable material 114 could otherwise create a gap between the mattress platform 120 and the lateral support member 116. The support provided by the lateral support member 116 provides additional support to not allow a baby to create a hazardous entrapment gap between the mattress platform 120 and the breathable material 114.

Figure 4:
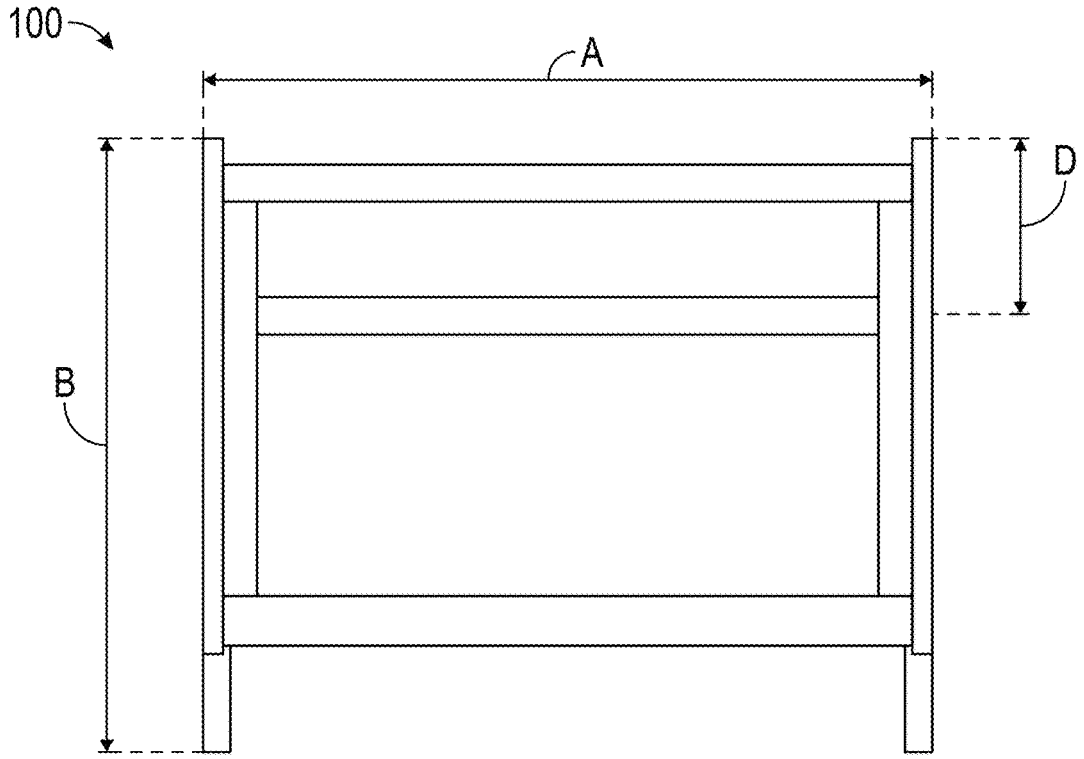
FIG. 4 shows a front/back view of the crib of FIG. 1A, according to an example embodiment of the present invention.
Figure 5:
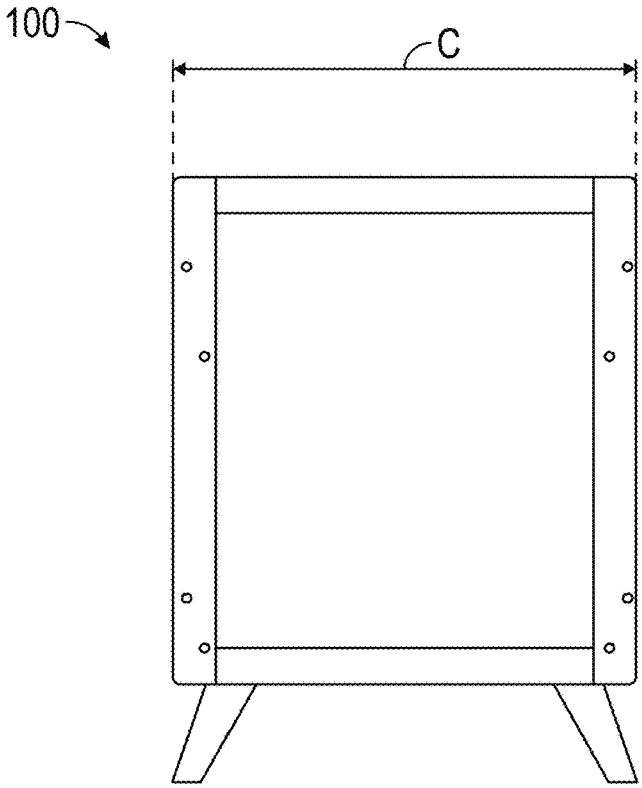
FIG. 5 shows an end view of the crib of FIG. 1A, according to an example embodiment of the present invention.
Figure 6:
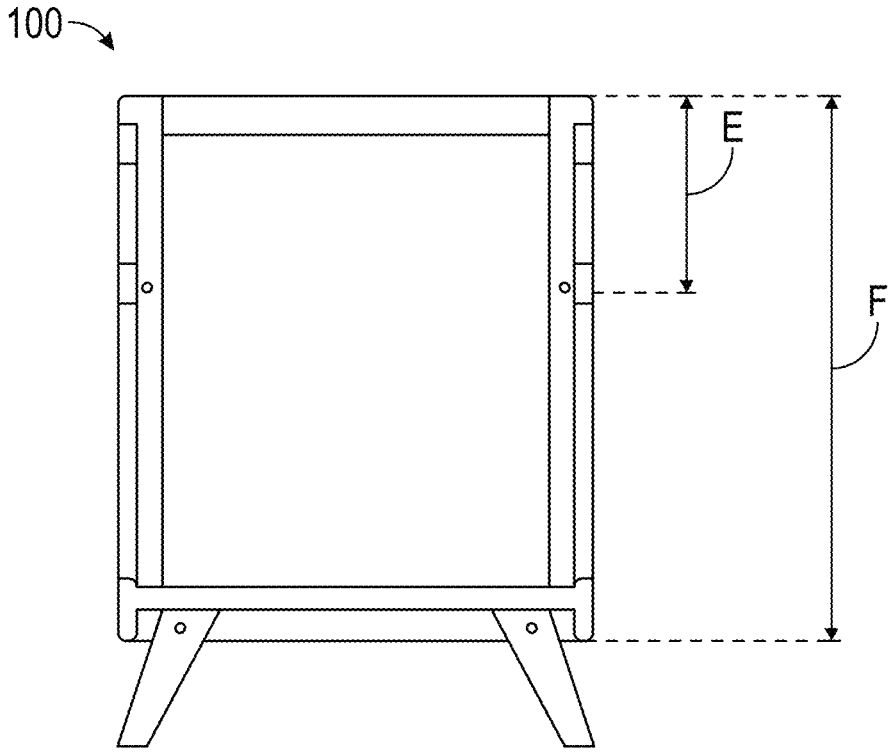
FIG. 6 shows another end view of the crib of FIG. 1A, according to an example embodiment of the present invention.
Figure 7:
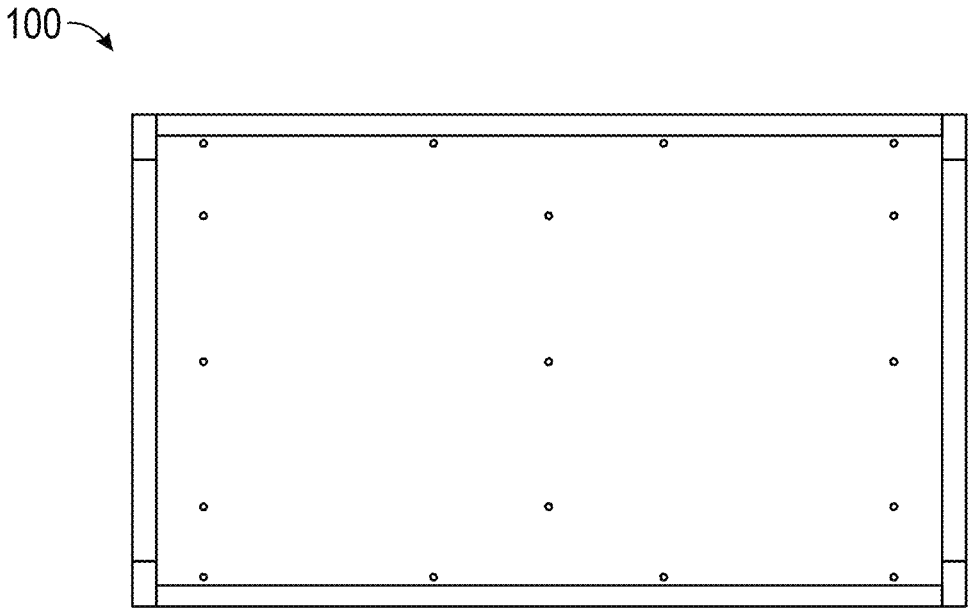
FIG. 7 is a top view of the crib of FIG. 1A, according to an example embodiment of the present invention.

FIG. 4 is a front view of the crib, which is similar to the back view. FIG. 5 is a first end view of the crib 100, and FIG. 6 is the other end view of the crib 100. FIG. 7 is a top view of the crib 100. The crib 100 has a length A, a height B, and a width C. In some embodiments, the length A is approximately between 38 and 42", the height B is approximately between 30 and 36," and the width C is approximately between 24 and 26". The lateral support member 116 may be positioned a distance D from the top of the crib that is approximately 9" below the top of the perimeter support 112. Also the mattress platform 120 may be movable between a first distance E and a second distance F from the top of the crib. For example, the mattress platform 120 may be movable between a first distance E, approximately 8 to 10" from the top of the crib, and a second distance F, approximately 24 to 28" from the top of the crib.

Figure 8:
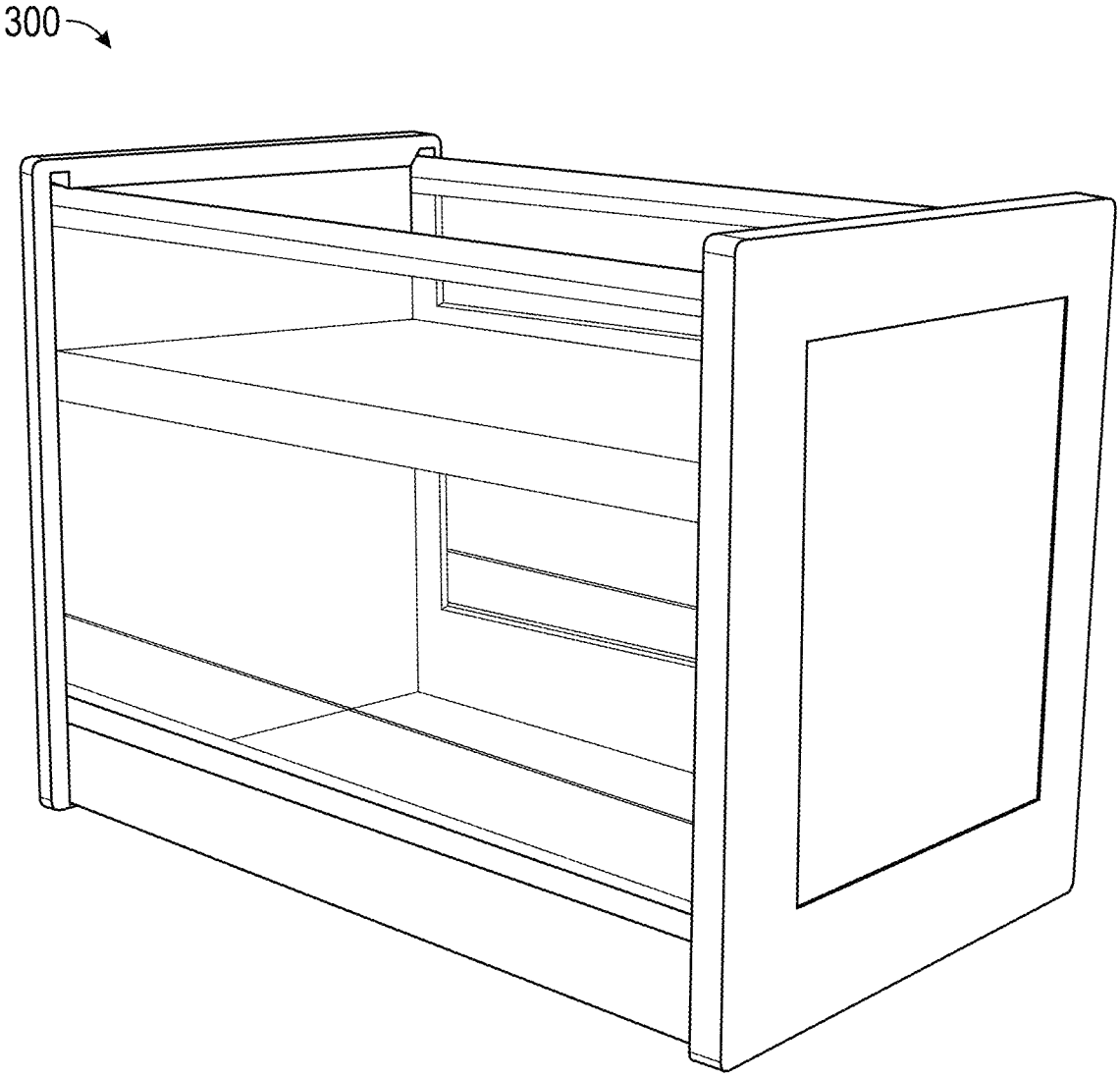
FIG. 8 is a perspective view of another embodiment of a breathable crib with the mattress support and mattress in a raised position, according to one example embodiment of the present invention.
Figure 9:
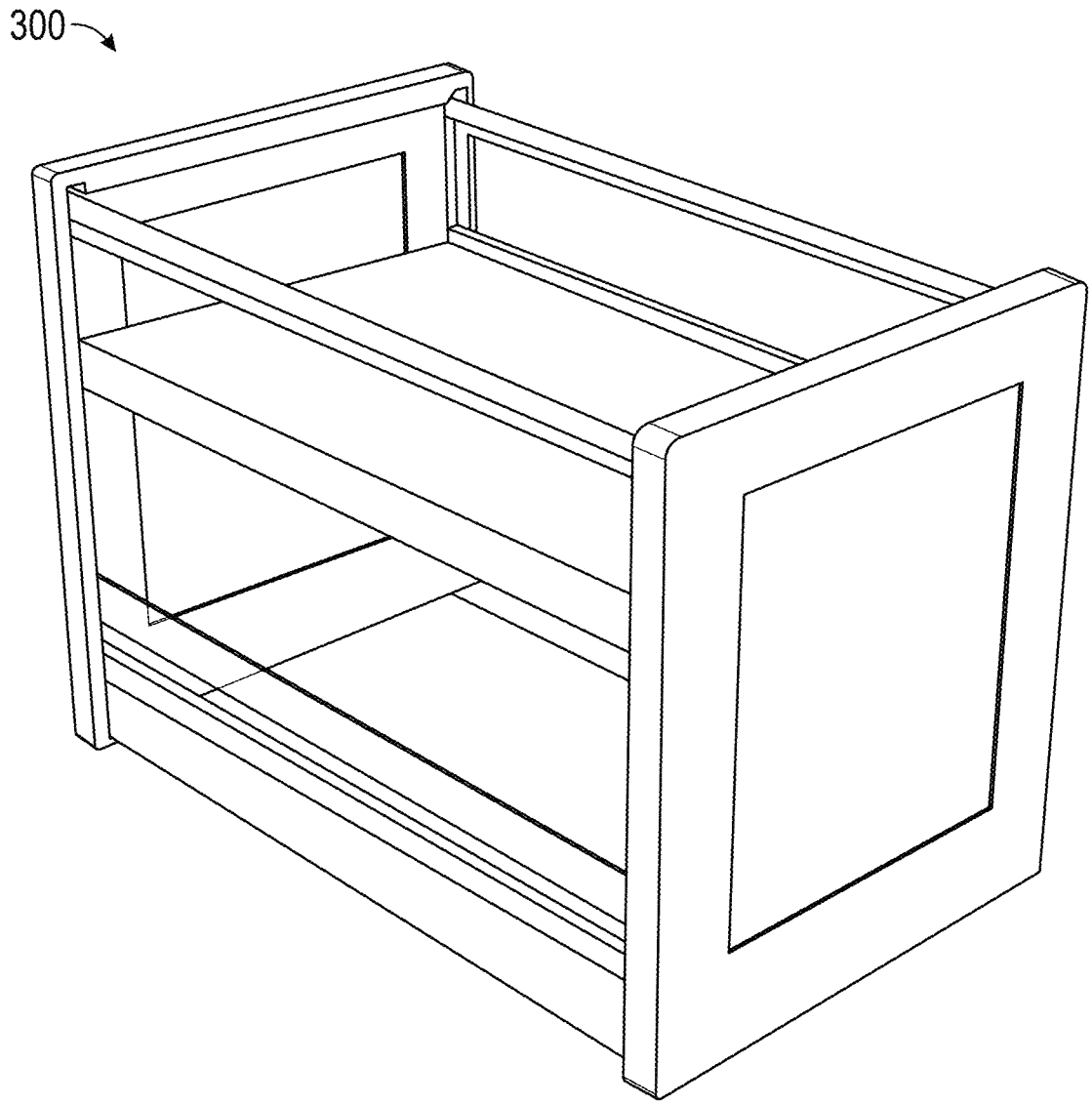
FIG. 9 is a perspective view of the crib of FIG. 8, according to an example embodiment of the present invention.
Figure 10:
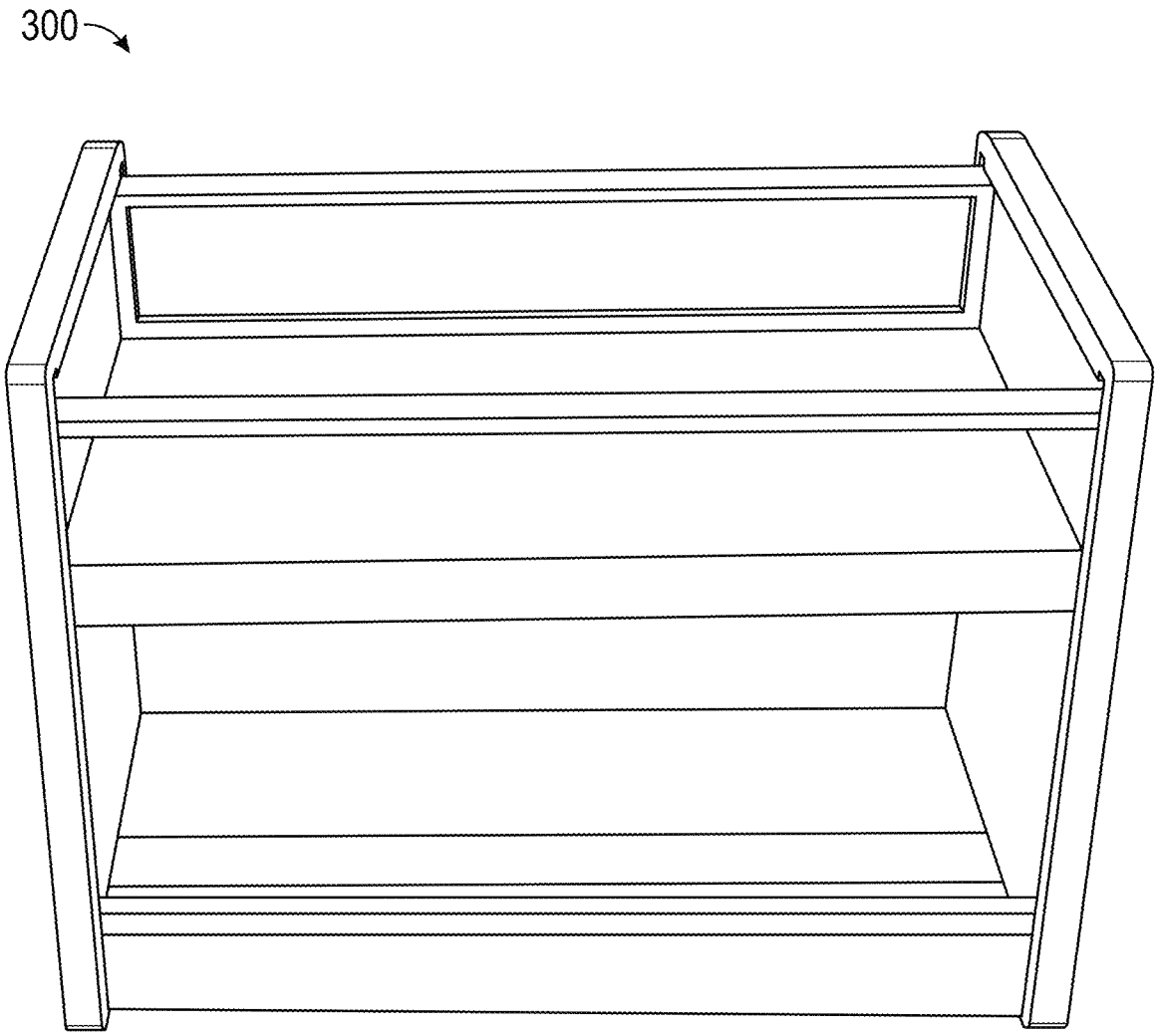
FIG. 10 is a front perspective view of the crib of FIG. 8, according to an example embodiment of the present invention.
Figure 11:
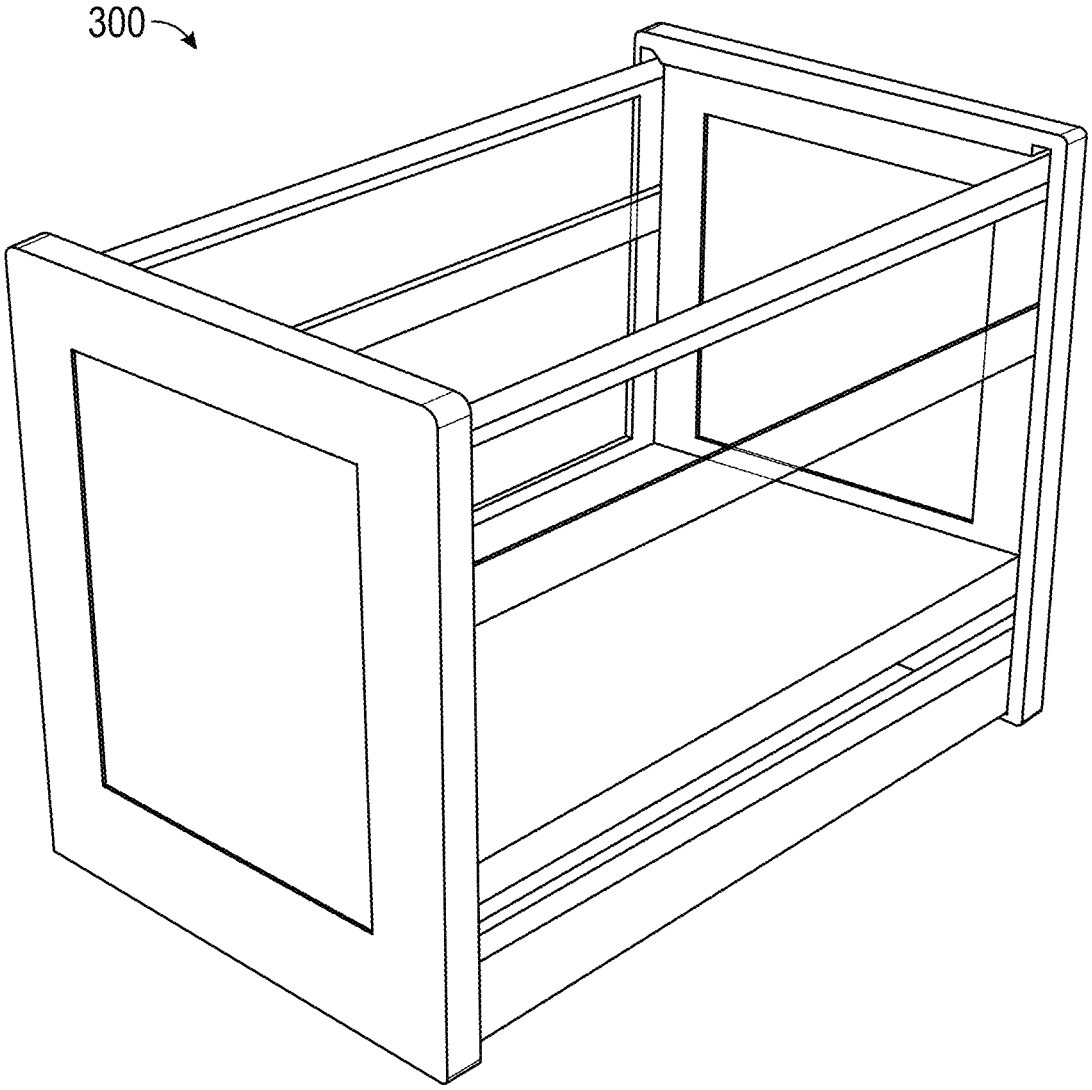
FIG. 11 is another perspective view of the crib of FIG. 8 with the mattress support and mattress in a lowered position, according to one example embodiment of the present invention.
Figure 12:
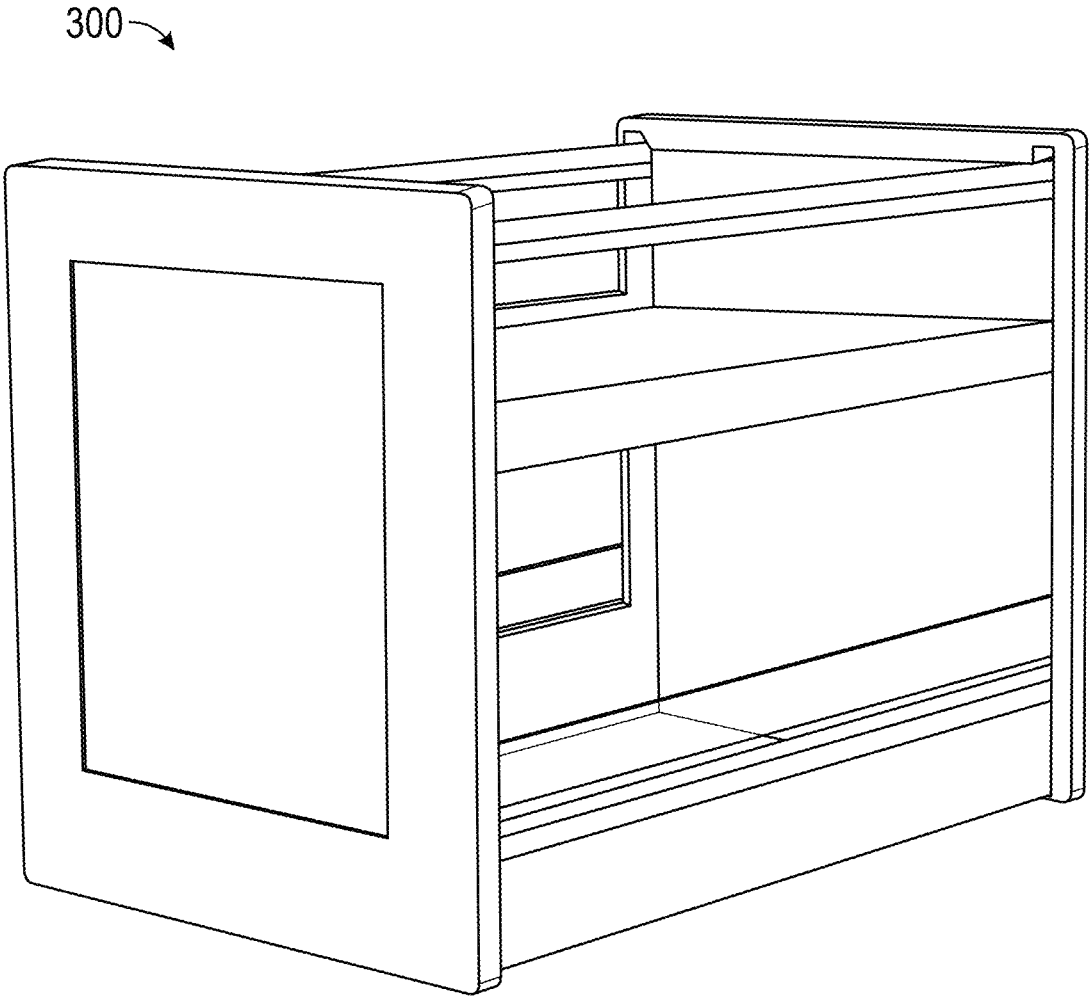
FIG. 12 is another perspective view of the crib of FIG. 8 with the mattress support and mattress in a raised position, according to one example embodiment of the present invention.
Figure 13:
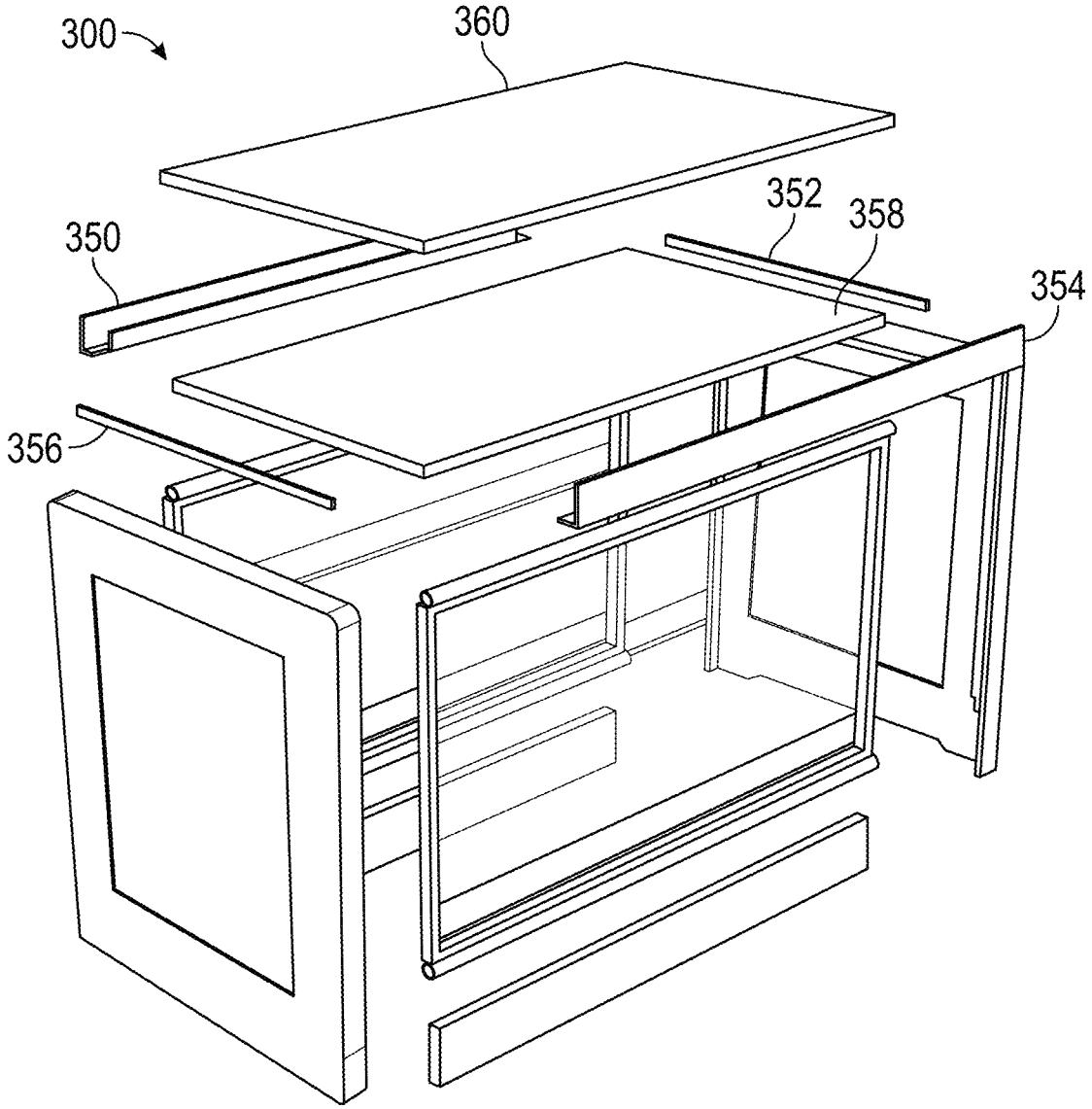
FIG. 13 is a second side view of the crib of FIG. 9, according to one example embodiment of the present invention.

FIG. 8 is a perspective finished photo view of a crib 300 having a breathable material, according to another example embodiment. FIGS. 9-14 are other views of the finished crib 300. Referring to FIG. 13, the crib 300 is illustrated in an exploded view showing the different parts of the crib 300, including the mattress platform's 320 components, including first, second, third and fourth frame elements 350, 352, 354, 356 along with a mattress support 358 retained by the frame elements 350, 352, 354, 356. A mattress 360 sits on top of the mattress support 358.

As used herein, the term mattress may include any structure disposed within a crib and upon which objects and/or human beings may be placed. In other words, mattress refers to any structure and not just a soft sleeping apparatus. For example, the crib could be configured into a playpen-type structure with a solid hard and/or flat bottom that is, for example, lowered very close to the floor. As such, and as used herein, a crib can be equated to and encompasses the various structures similar to a crib, such as those for containing a small child (e.g., playpens, portable cribs, basinets, convertible cribs, round cribs, or other structures including, for example, spaced-apart side supports that require an apparatus or system such as that described herein).

Figure 14:
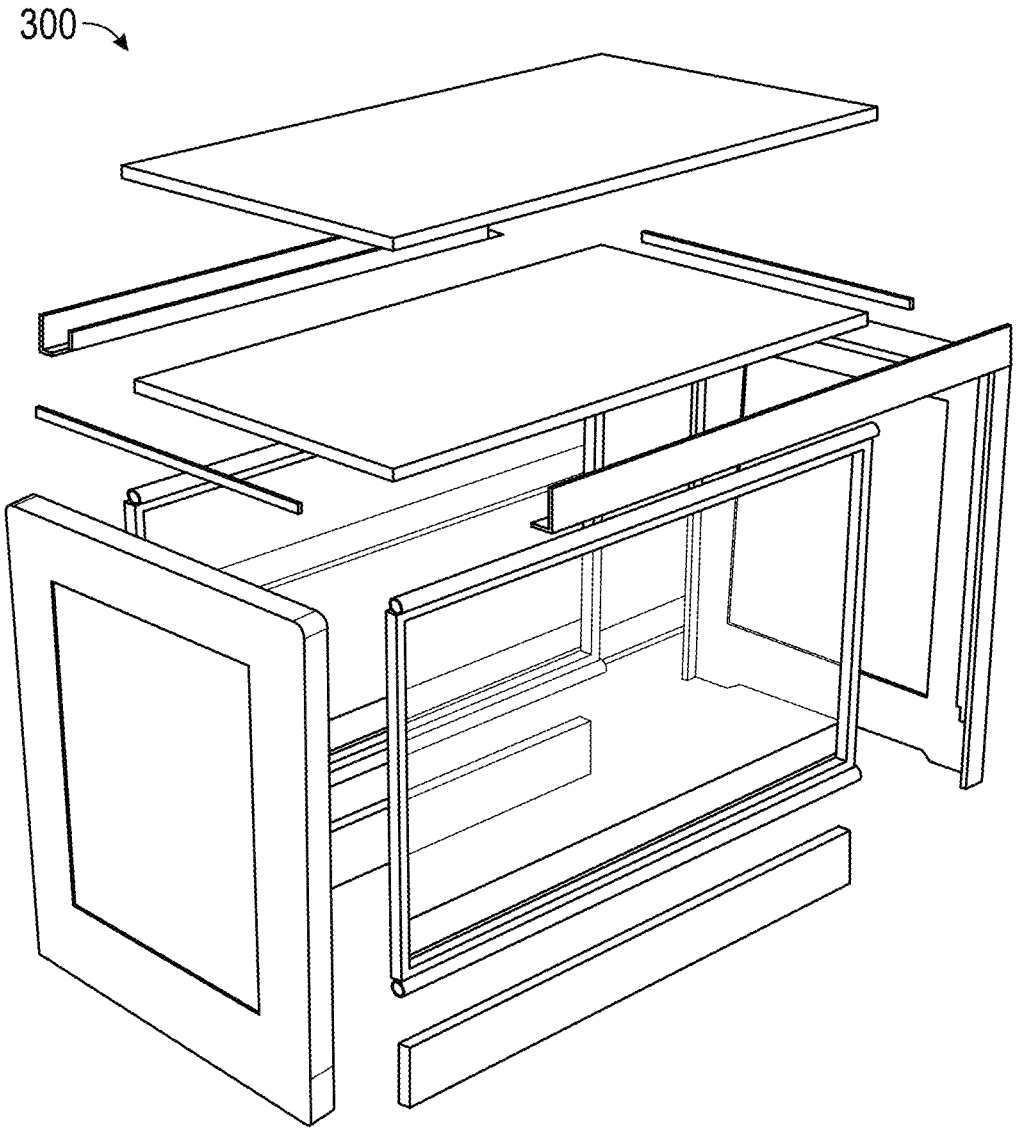
FIG. 14 is a top view of the crib of FIG. 9, according to one example embodiment of the present invention.

FIG. 14 is an exploded assembly view of the crib. Preferably, the crib 300 ships with fully assembled front and back panel frames A, full assembled side panels B, a mattress support panel C, mattress support rails D and G, side mounting extrusions E, back base rails F and a mattress H. During assembly, a user attaches the front and back panels A to side wood panels B using bolts, and lock washers through side mounting extrusions E to threated inserts in side wood panels (A to E to B). Then, the user attaches front and back base rails F to side wood panels B using a hidden K/D fastener solution such as Minifix and Cam (F to B). The user inserts the mattress support panel sub assembly (D plus D) on to the mattress side support rails G previously installed by manufacturer and top with mattress H.

Figure 15:
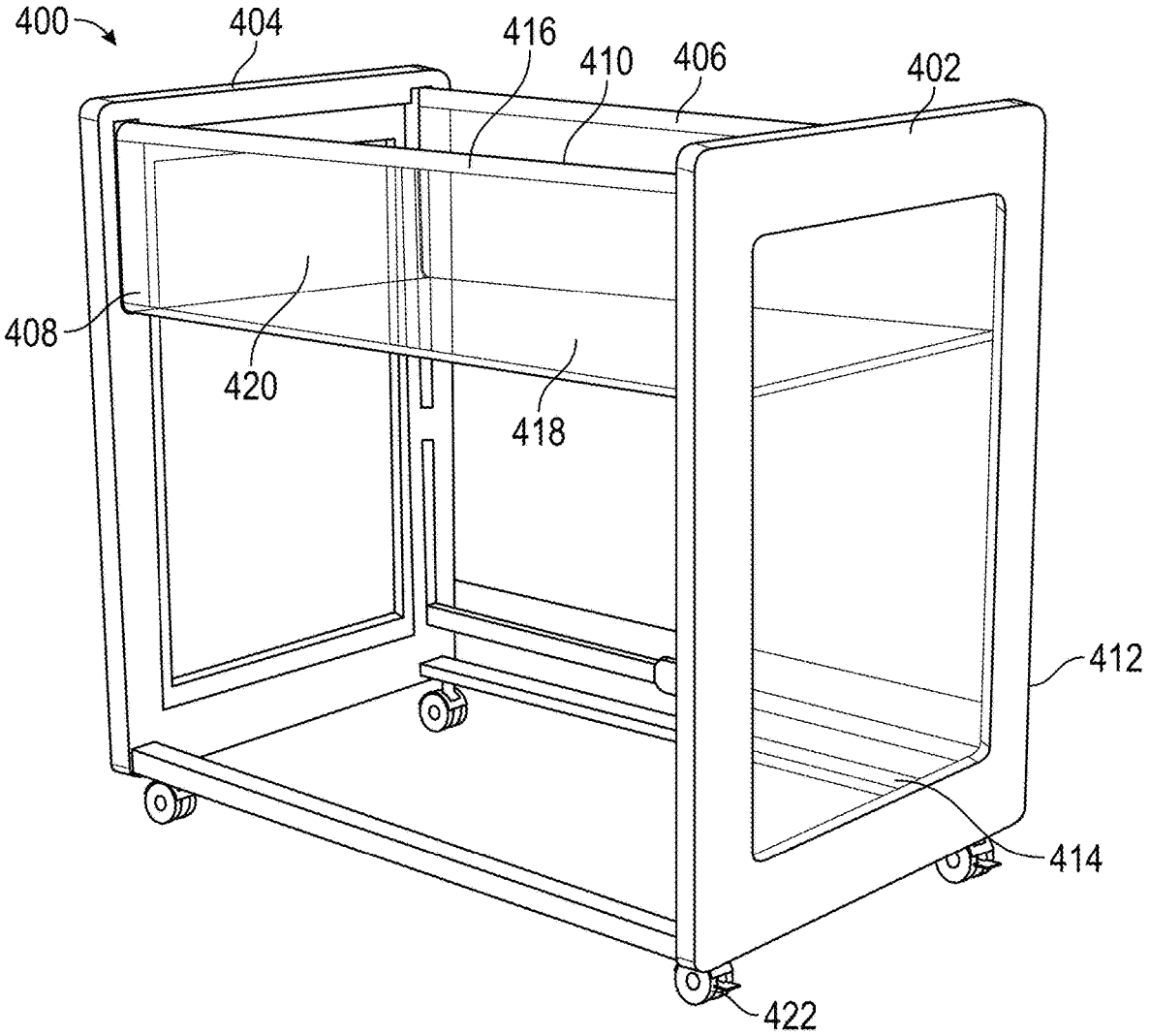
FIG. 15 shows a perspective view of another embodiment of a crib, according to example embodiment of the present invention.

FIG. 15 illustrates another example embodiment of a crib 400. The crib 400 includes a first side 402, second 404, third side 406 and fourth side 408. Preferably, the third side 406 and fourth side 408 are wider than the first side 402 and second side 404, such that the four sides 402, 404, 406, 408 define a generally rectangular interior space 410. As illustrated in FIG. 15, the first side 402 includes a solid perimeter construction 412 with a breathable material 414 there between for aesthetic reasons, structural support and to prevent entrapment of the infants' limbs. Of course, one of ordinary skill in the art would recognize that alternative designs are also possible. Likewise, the second side 404 has similar construction.

Figure 16:
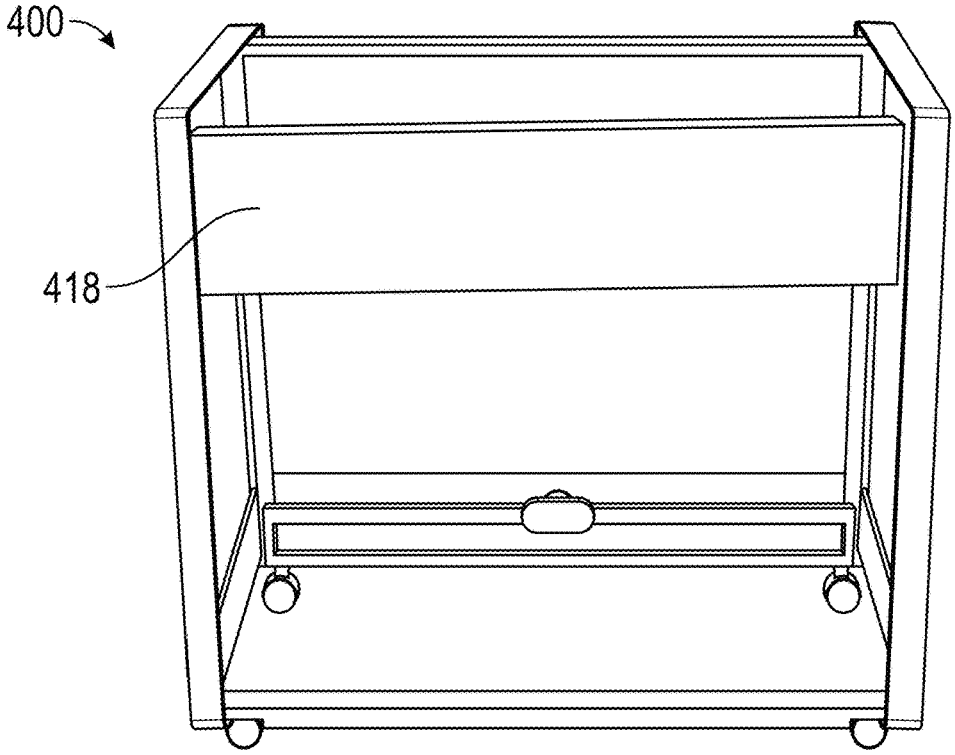
FIG. 16 shows another view of the crib of FIG. 15 with the mattress support in a first, raised position, according to an example embodiment of the present invention.
Figure 17:
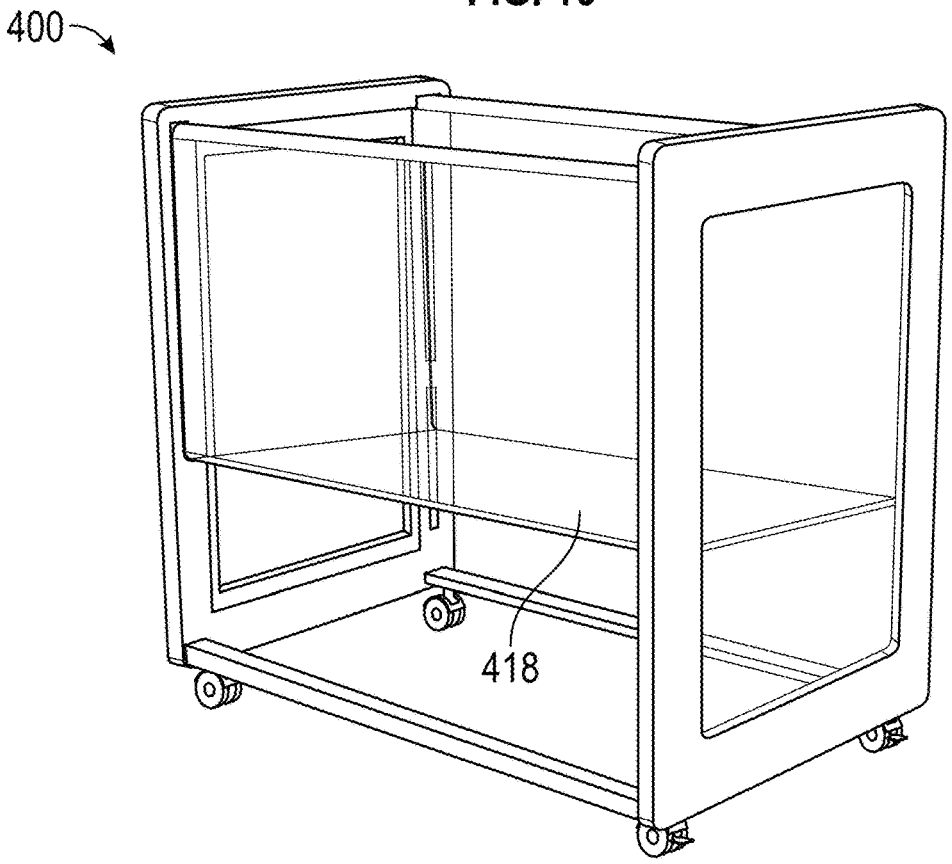
FIG. 17 shows another view of the crib of FIG. 15 with the mattress support in a second position, according to an example embodiment of the present invention.
Figure 18:
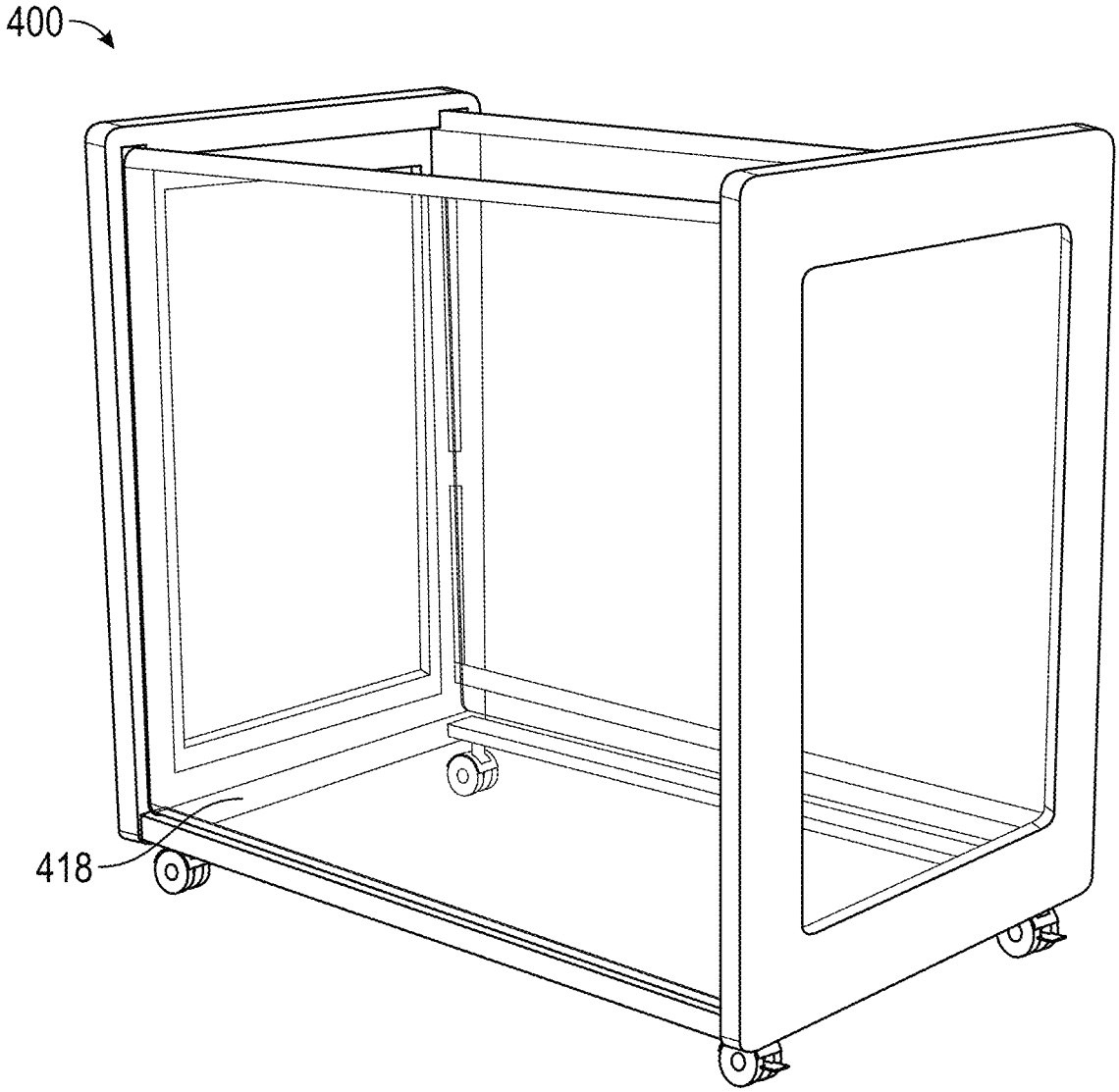
FIG. 18 shows another view of the crib of FIG. 15 with the mattress support in a third, lowered position, according to an example embodiment of the present invention.

Preferably, the fourth side 408 includes a top support member 416 and a bottom support member 418. The top support member 416 is fixed to the first side 402 and second side 404 such that it is not movable. The bottom support member 418 is movably attached between the first side 402 and second side 404 such that the bottom support member 418 can move between different positions with respect to the top support member 416. As illustrated in FIG. 16, the bottom support member 418 is in a first position similar to a bassinet position. As illustrated in FIG. 17, the bottom support member 418 is a second position similar to a mini crib position. As illustrated in FIG. 18, the bottom support member 418 is in a third even lower position. The top support member 416 and the bottom support member 418 are wrapped by a breathable material 420. The breathable material 420 is securely attached around the top support member 416 on one side of the crib and loosely attached about the top support member 416 on another side of the crib and moveably secured around the bottom support member 418, such that when the bottom support member 418 is moved the breathable material 420 also moves in ensure the entire interior of the crib 400 is wrapped in a breathable material 420 to keep the infant safe.

The breathable material 420 can be any material that allows air to flow through it, including a mesh like material. The breathable material 420 also allows the crib sides to be sec through to see the infant inside. The third side 406 also has s similar construction to the fourth side 408. The crib 400 further includes rollers or casters 422 that support the crib 400. The rollers or casters 422 allow the crib to be more easily moved about. One of ordinary skill in the art would also recognize that other supports such as leg designs are possible.

Figure 19:
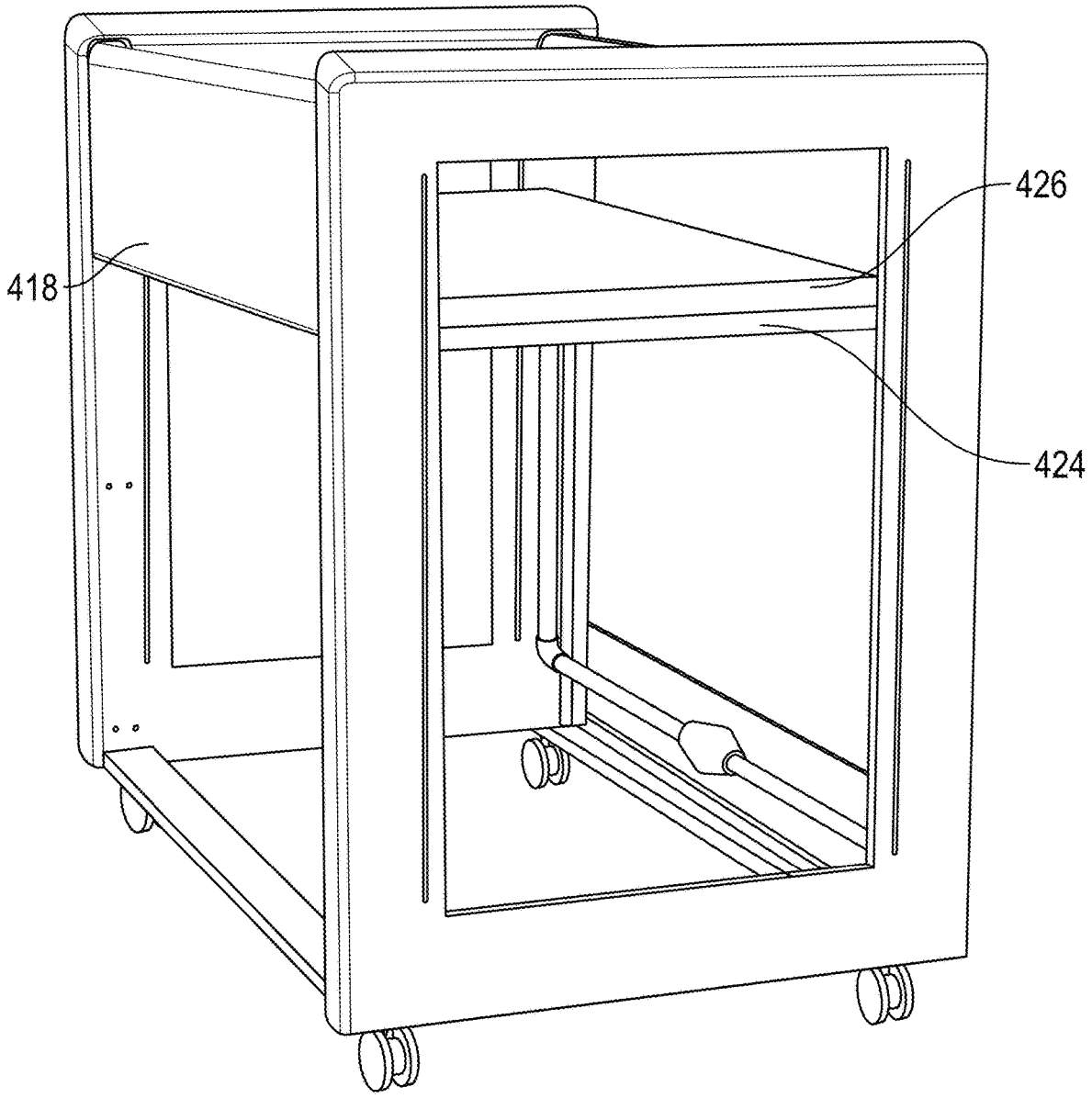
FIG. 19 shows another view of the crib of FIG. 15, according to an example embodiment of the present invention.
Figure 20:
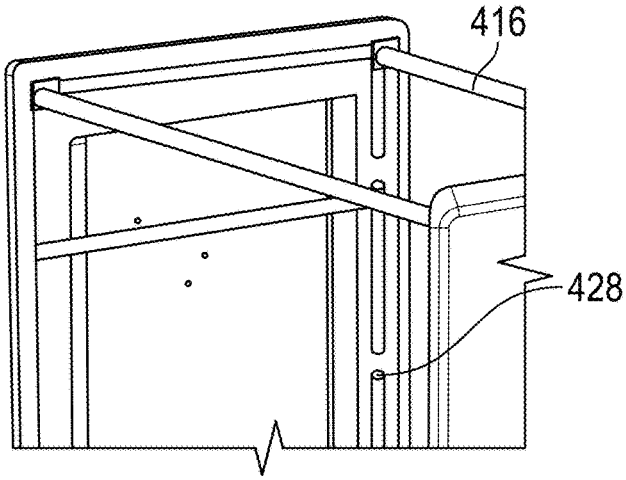
FIG. 20 is an illustration a top support member of the crib of FIG. 15, according to an example embodiment of the present invention.
Figure 21:
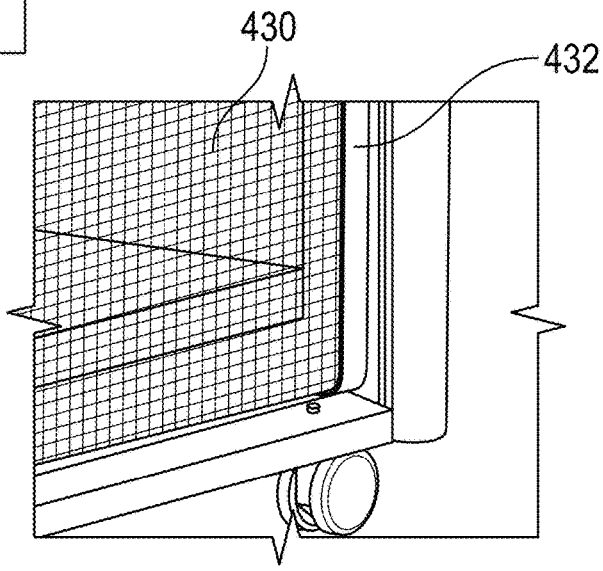
FIG. 21 is an illustration of a mesh gap of the crib of FIG. 15, according to an example embodiment of the present invention.
Figure 22:
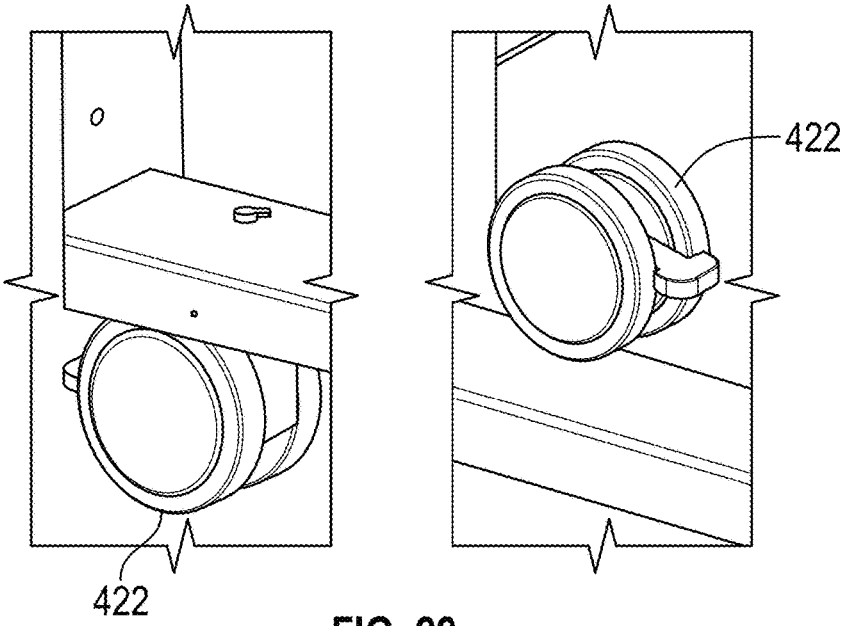
FIG. 22 is an illustration of a roller storage feature of the crib of FIG. 15, according to an example embodiment of the present invention.

FIG. 19 further illustrates crib 400. The crib 400 also includes a mattress platform 424 and a mattress 426 that moves up and down as the bottom support member 418 is moved up and down. FIG. 20 illustrates the top support member 416 and illustrates a hole position 428 that can retain the bottom support member 418 in a first position. FIG. 21 illustrates a gap between a mesh sling 430, described in more detail below, and the third and fourth sides 406, 408 restrained by a Velcro restraint strip 432. FIG. 22 is a blow up of the caster or roller 422. The caster or roller is retained under the crib 400 by a cotter pin 434. The cotter pin 434 can be removed by the user and the roller 422 can be removed to enable the crib 400 to more securely stand on the floor. The roller 422 can be reinstalled above the bottom of the crib in reverse to store the roller 422.

Figure 23:
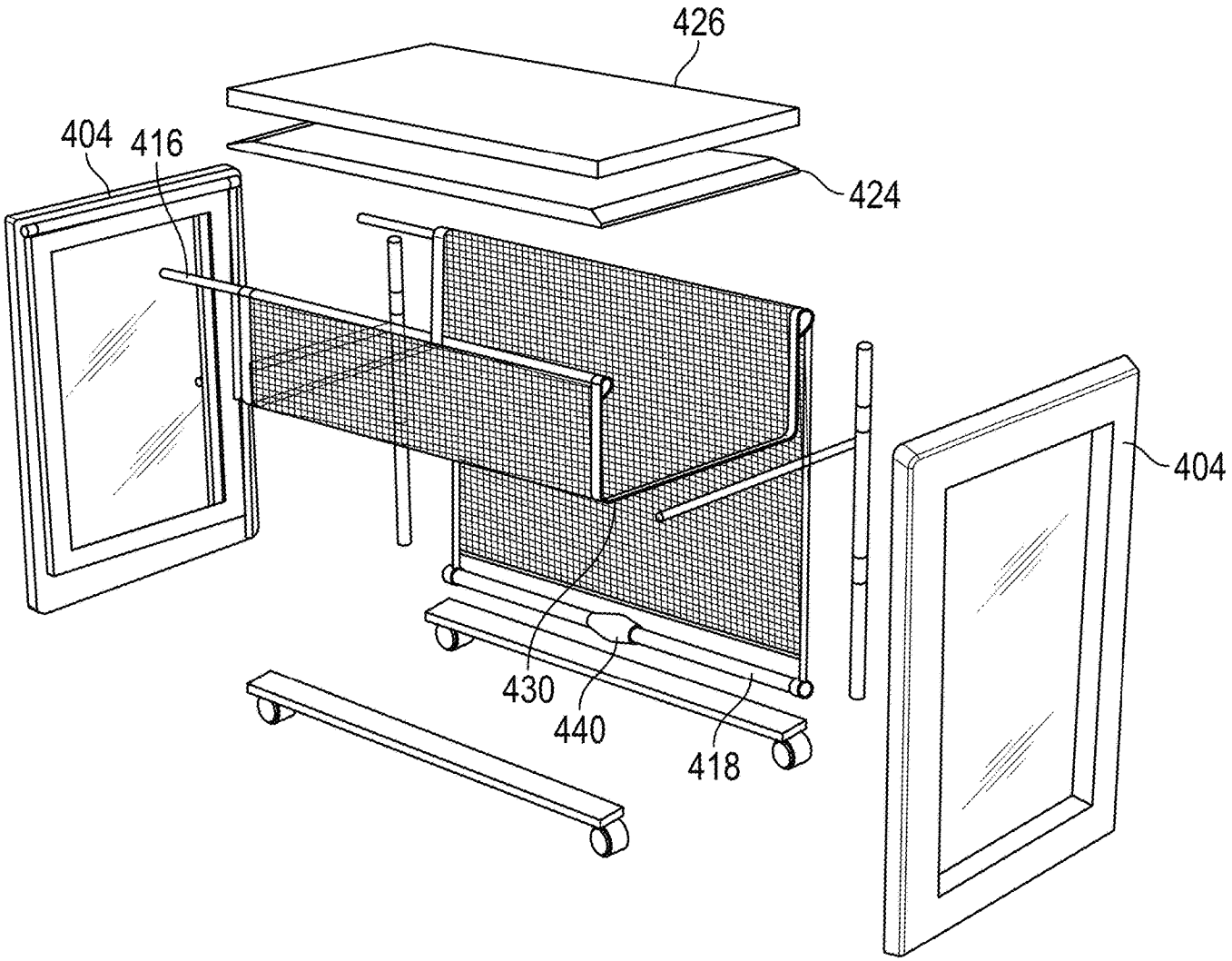
FIG. 23 is an exploded view of the crib of FIG. 15 and the moving mesh sling design, according to an example embodiment of the present invention.

FIG. 23 is a blow up diagram of the crib 400 that illustrates the workings of the mesh sling 430. In general the mesh sling 430 is designed to allow the mesh to move up and down as the bottom support member 418 is moved up and down such that the mesh encloses the interior of the crib 400 in any position as shown in FIGS. 16-18. The mesh will slide about the bottom support members 418 to create a mesh sling for retention of the mattress support 424 and mattress 426. A double action locking handle is used to facilitate movement of the mesh sling to the various positions.

Figure 24:
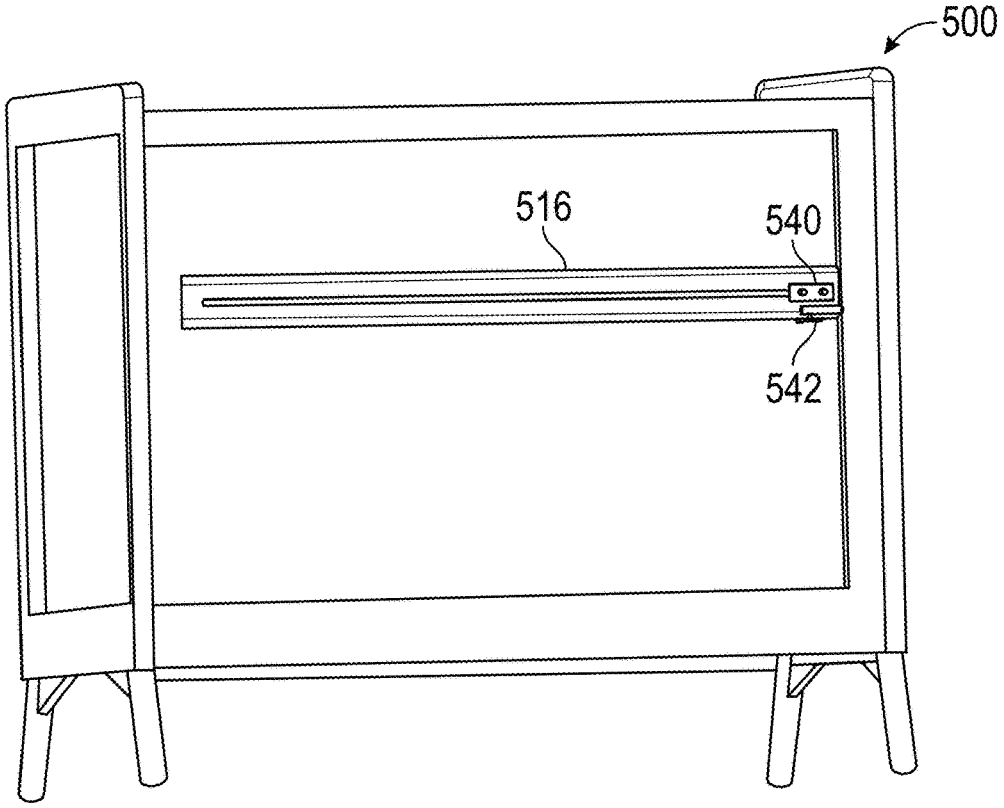
FIG. 24 is a perspective view of crib having an adjustable lateral support member, according to an example embodiment of the present invention.
Figure 25:
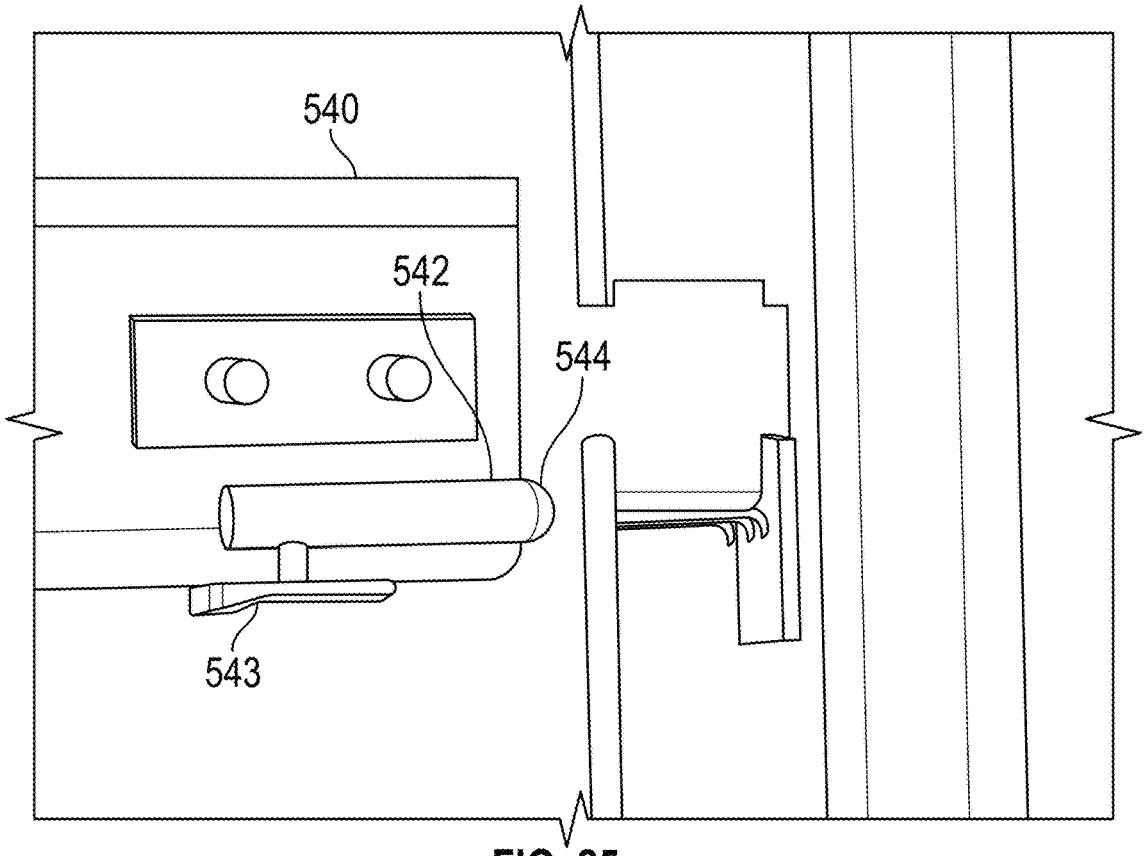
FIG. 25 is a transparent view of the adjustable mechanism of the lateral support member of FIG. 24, according to an example embodiment of the present invention.
Figure 26:
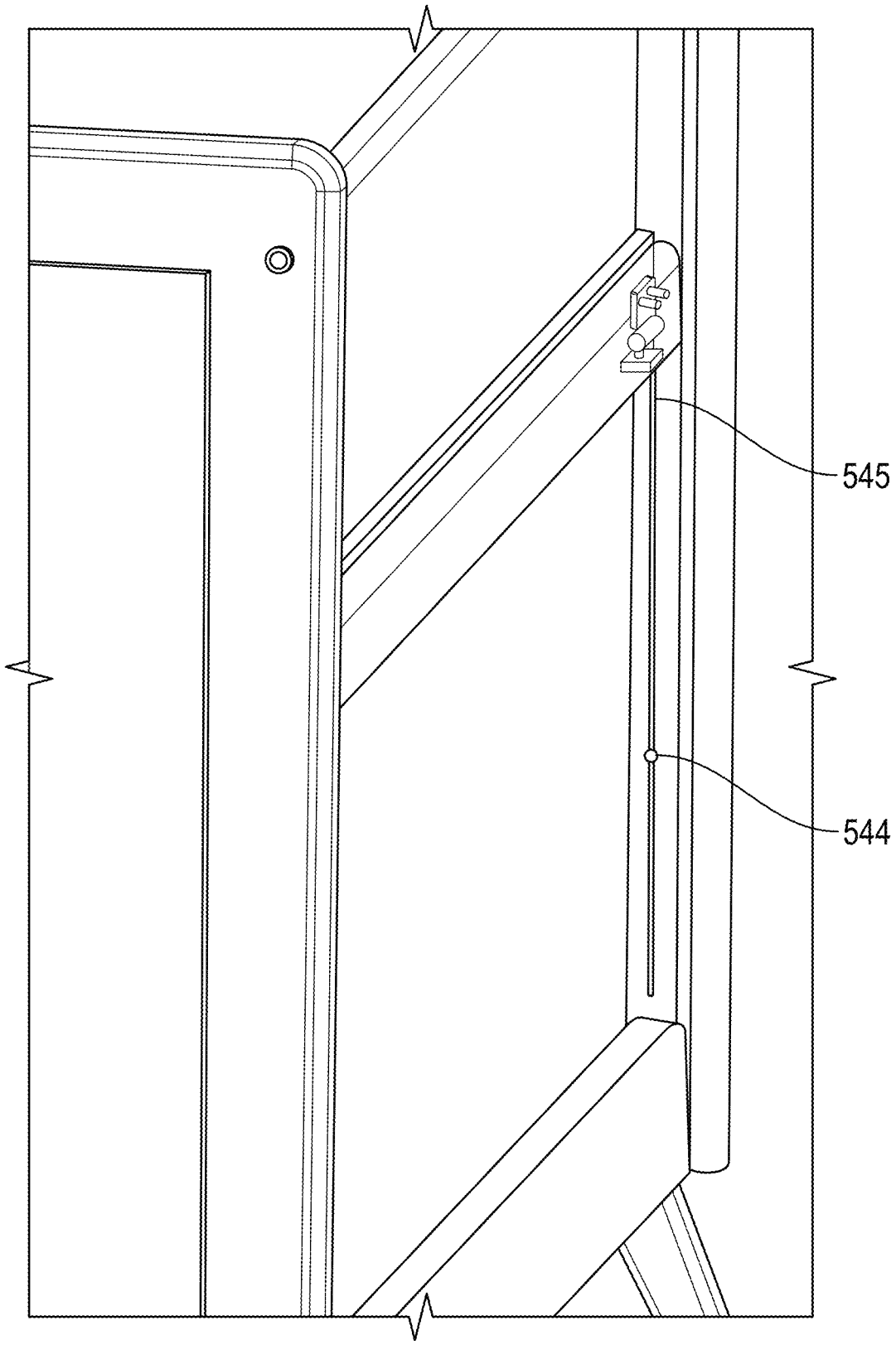
FIG. 26 is a perspective view of a sliding channel for the adjustable mechanism of FIG. 25, according to an example embodiment of the present invention.

FIG. 24 illustrates a crib 500 having a lateral support member 516, according to another example embodiment. The lateral support member 516 includes a height adjustment mechanism 540 with a releasable locking pin 542. FIG. 25 is a blown up view of the height adjustment mechanism 540. The releasable locking pin 542 can be released by a release mechanism 542 to release or engage the pin 542 with a hole 544 in a channel. FIG. 26 illustrates the channel 545. By releasing the pin 542, the lateral support member 516 can slide up and down in the channel 545 and can be secured in locations with holes 544 in the channel 545 by letting pin 542 rest in the hold 544 in the channel.

Figure 27:
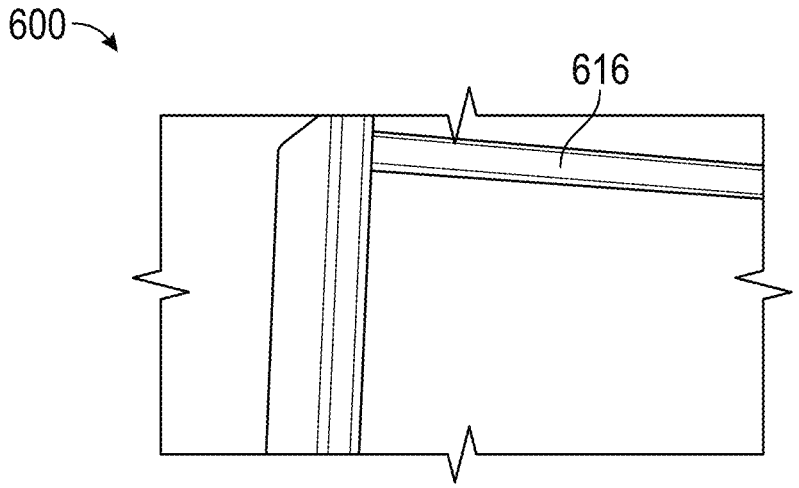
FIG. 27 is a perspective view of a zipper used as a lateral support member, according to an example embodiment of the present invention.
Figure 28:
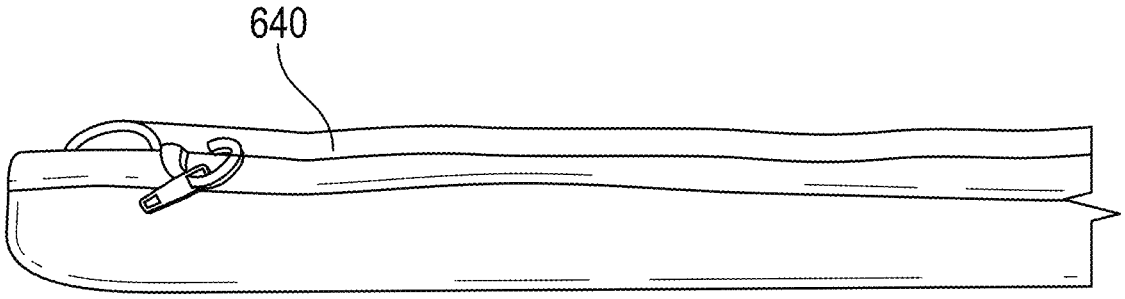
FIG. 28 is view of one side of the zipper of FIG. 27 attached to the mattress cover for the mattress platform, according to an example embodiment of the present invention.
Figure 29:
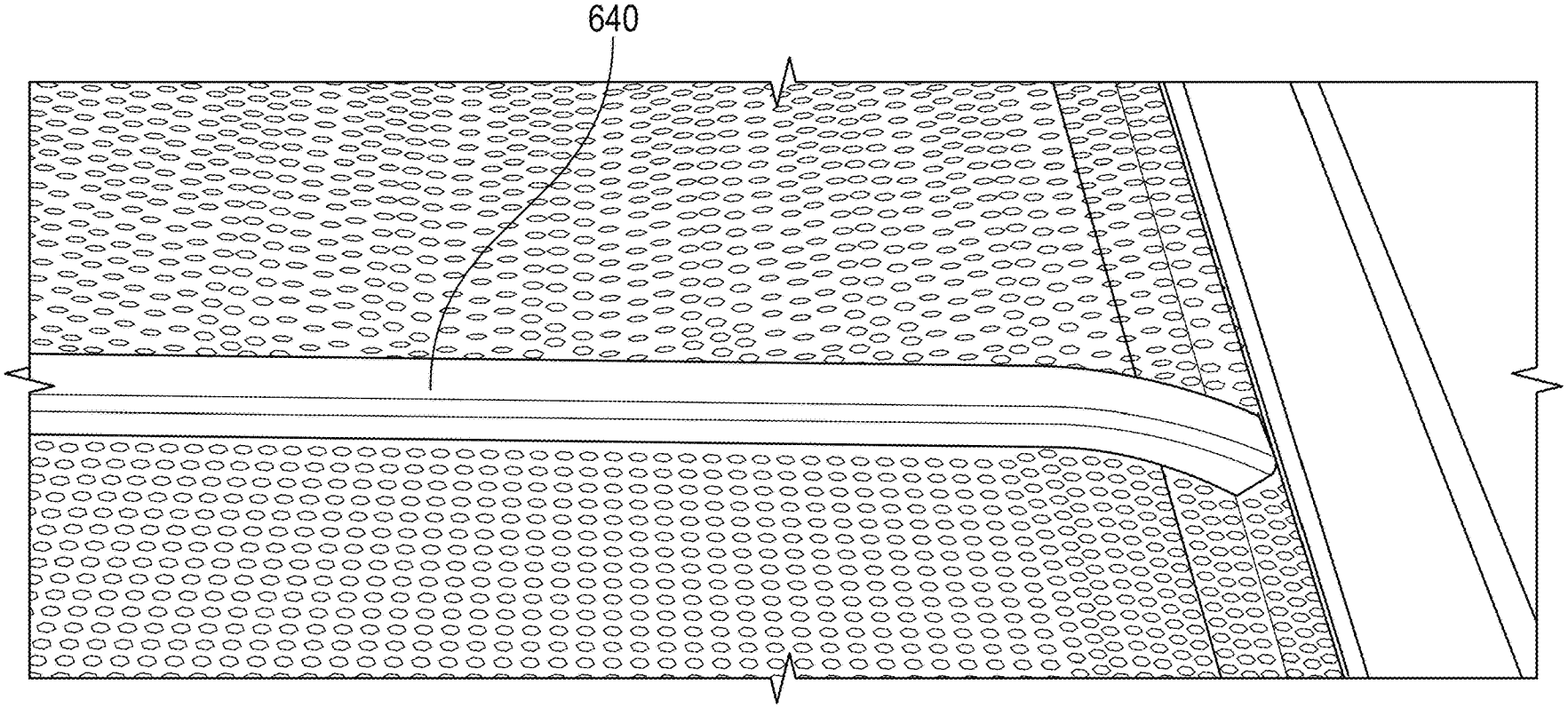
FIG. 29 is a view of the other side of the zipper of FIG. 27 attached to the breathable material on the inside of the crib, according to an example embodiment of the present invention.
Figure 30:
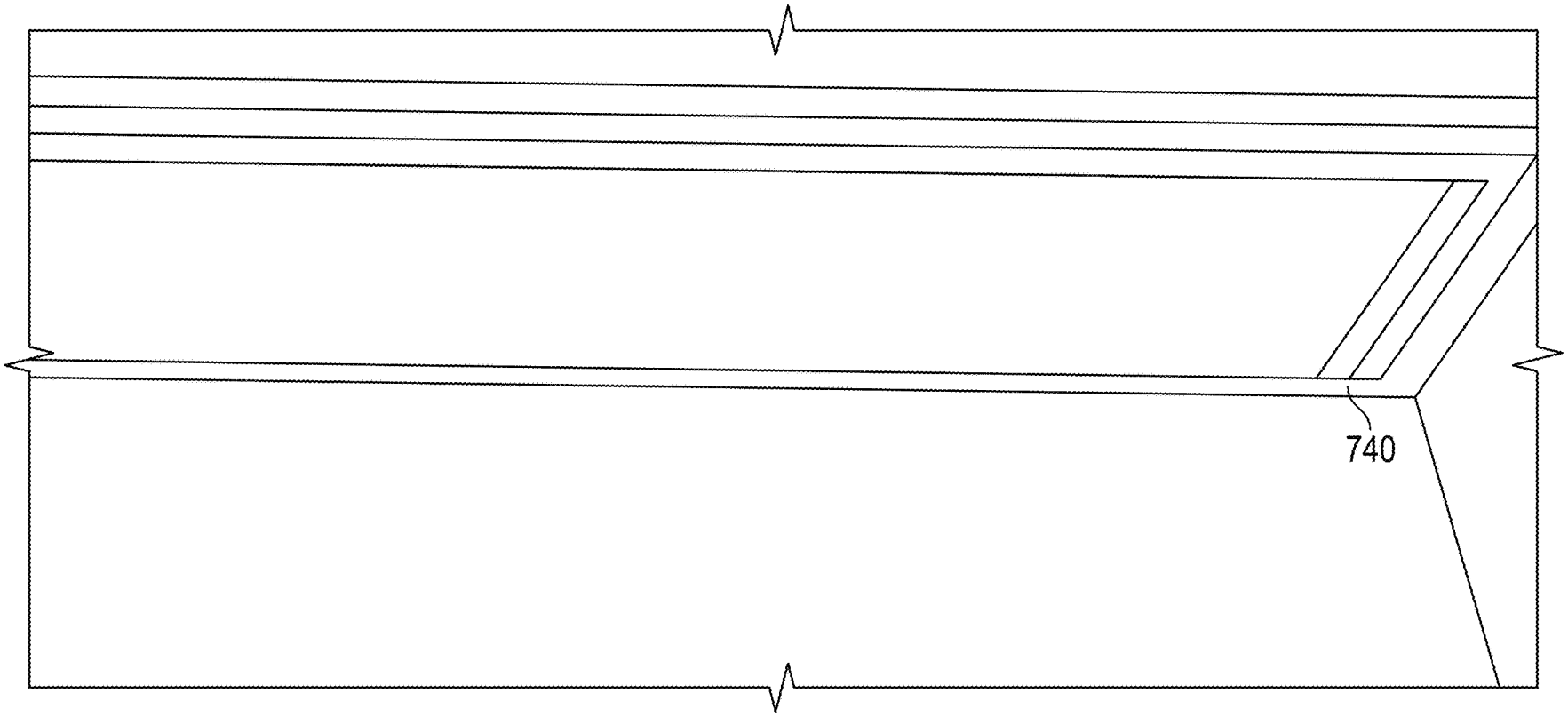
FIG. 30 is a perspective view of a crib that has a hook and look mechanism used as a lateral support member, according to an example embodiment of the present invention.
Figure 31:
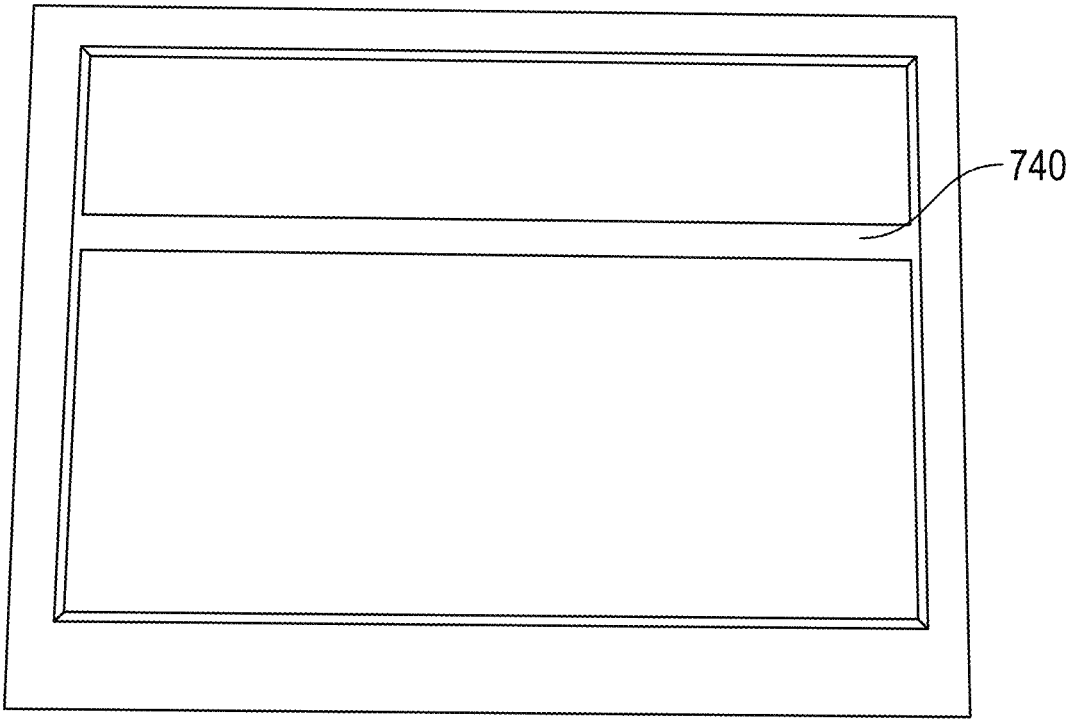
FIG. 31 is an outside view of the breathable material with the hook and look mechanism of FIG. 30, according to an example embodiment of the present invention.
Figure 32:
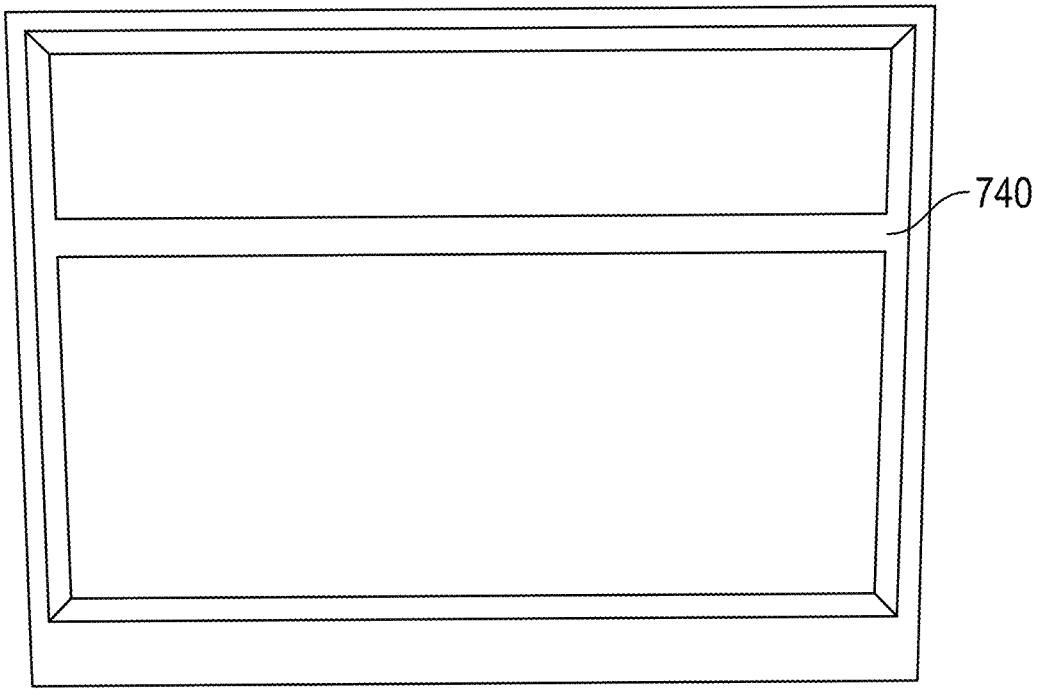
FIG. 32 is an inside view of the hook and look mechanism of FIG. 30, according to an example embodiment of the present invention.

FIG. 27 illustrates a crib 600 have a lateral support member 616, according to another example embodiment. In this embodiment, the lateral support member 616 is a double side zipper 640. Referring to FIGS. 28 and 29, the zipper 640 can be zipped on one side to the mattress platform (FIG. 28) and zipped on the other side to the breathable material. As such, the breathable material is prevented from bowing out in the area of the mattress platform. Referring to FIGS. 30-32, likewise a hook and loop mechanism can be used in lieu of a zipper.

Figure 1B:
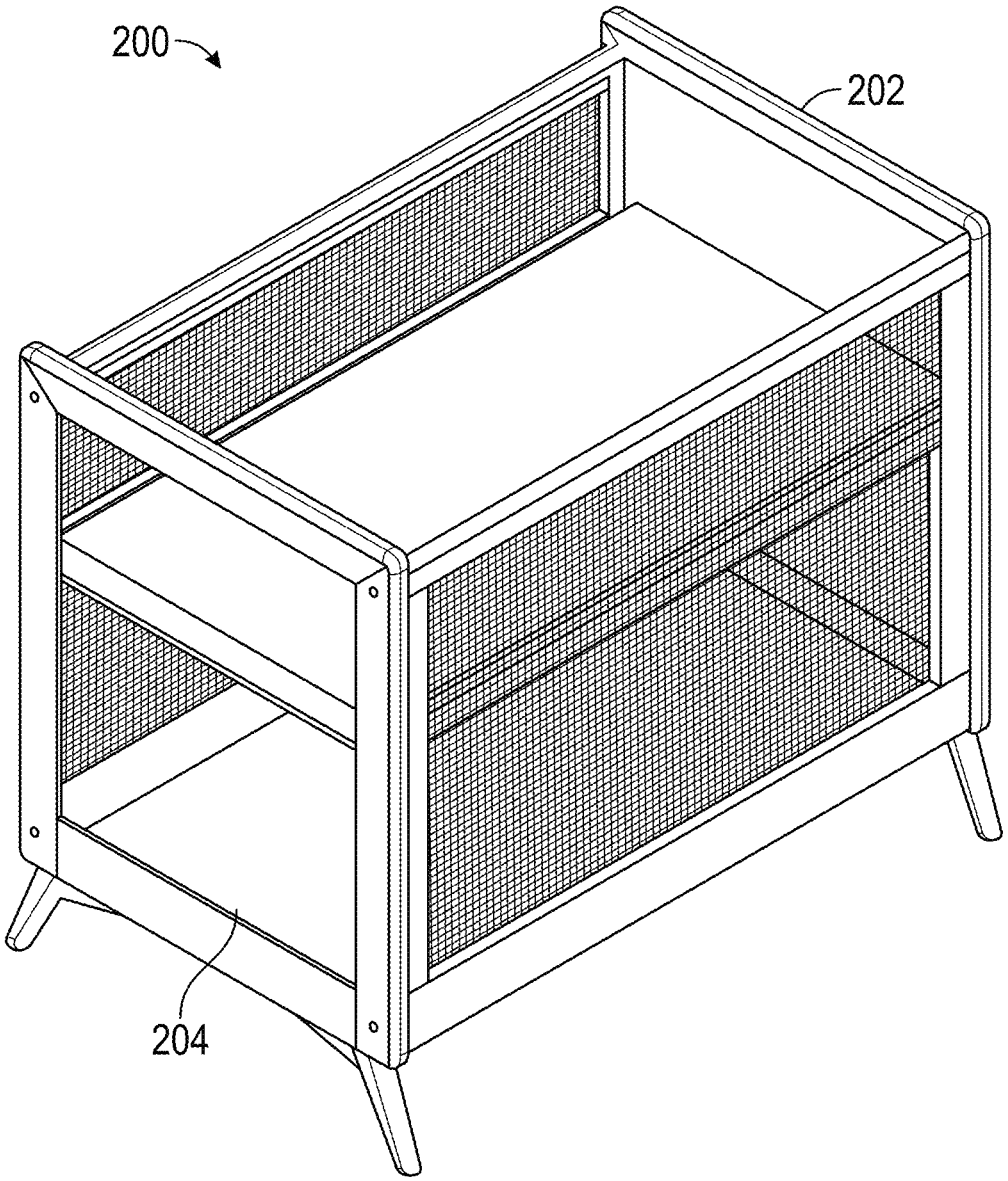
FIG. 1B shows a perspective view of another embodiment of a crib, according to one example embodiment of the present invention.
Figure 33:
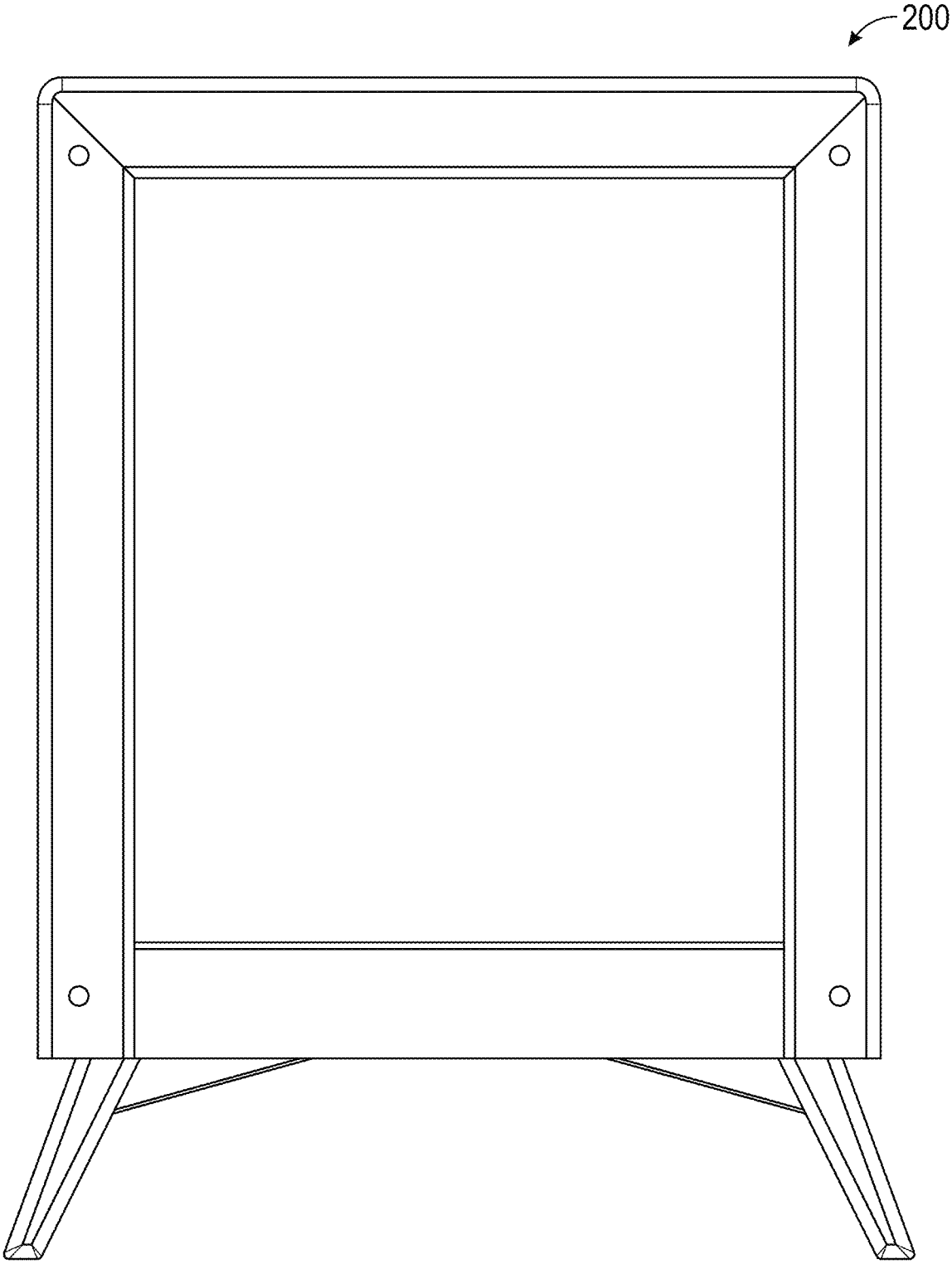
FIG. 33 shows a left and right side view of the crib of FIG. 1B, according to an example embodiment of the present invention.
Figure 34:
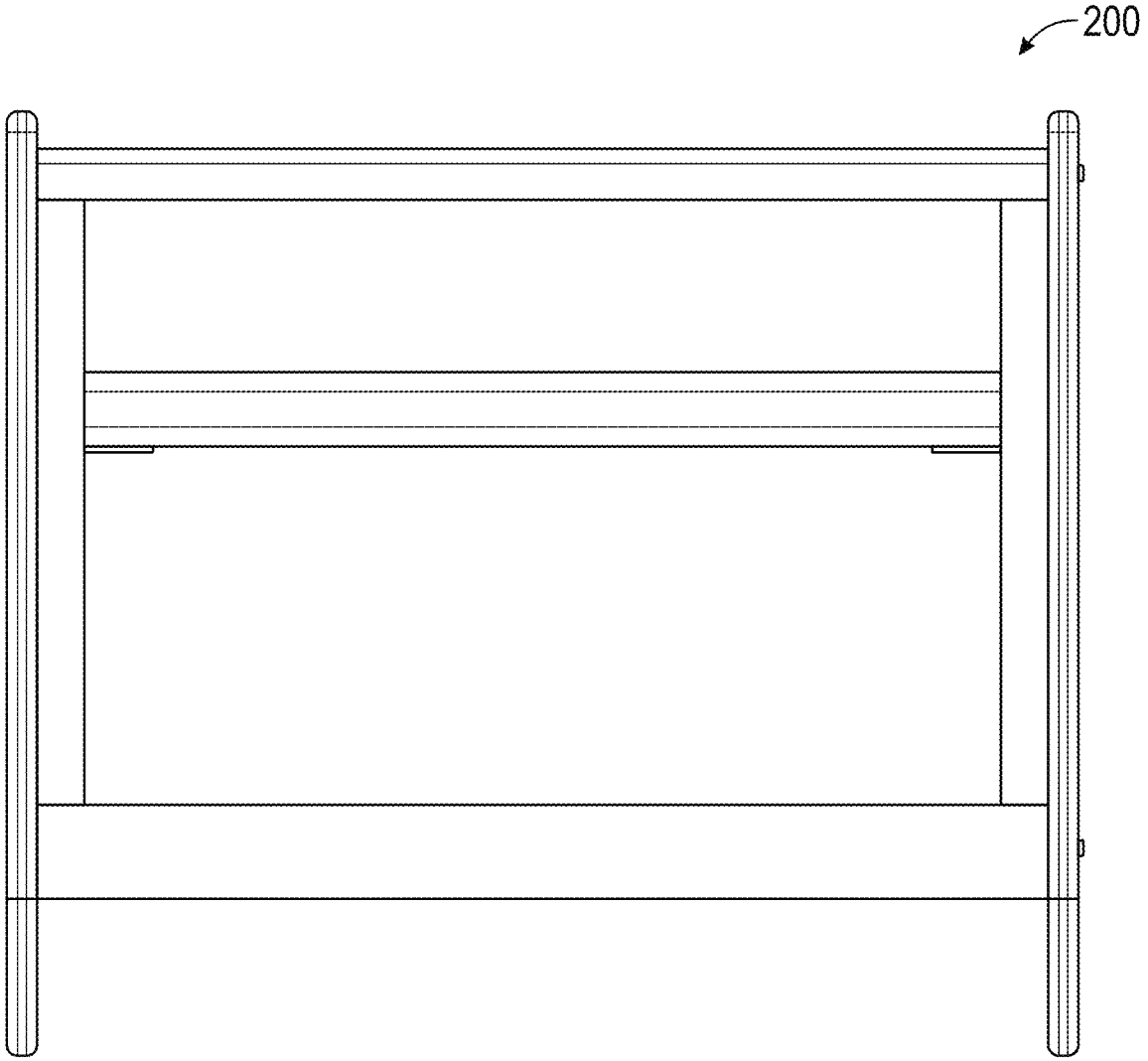
FIG. 34 shows a front/back view of the crib of FIG. 1B, according to an example embodiment of the present invention.
Figure 35:
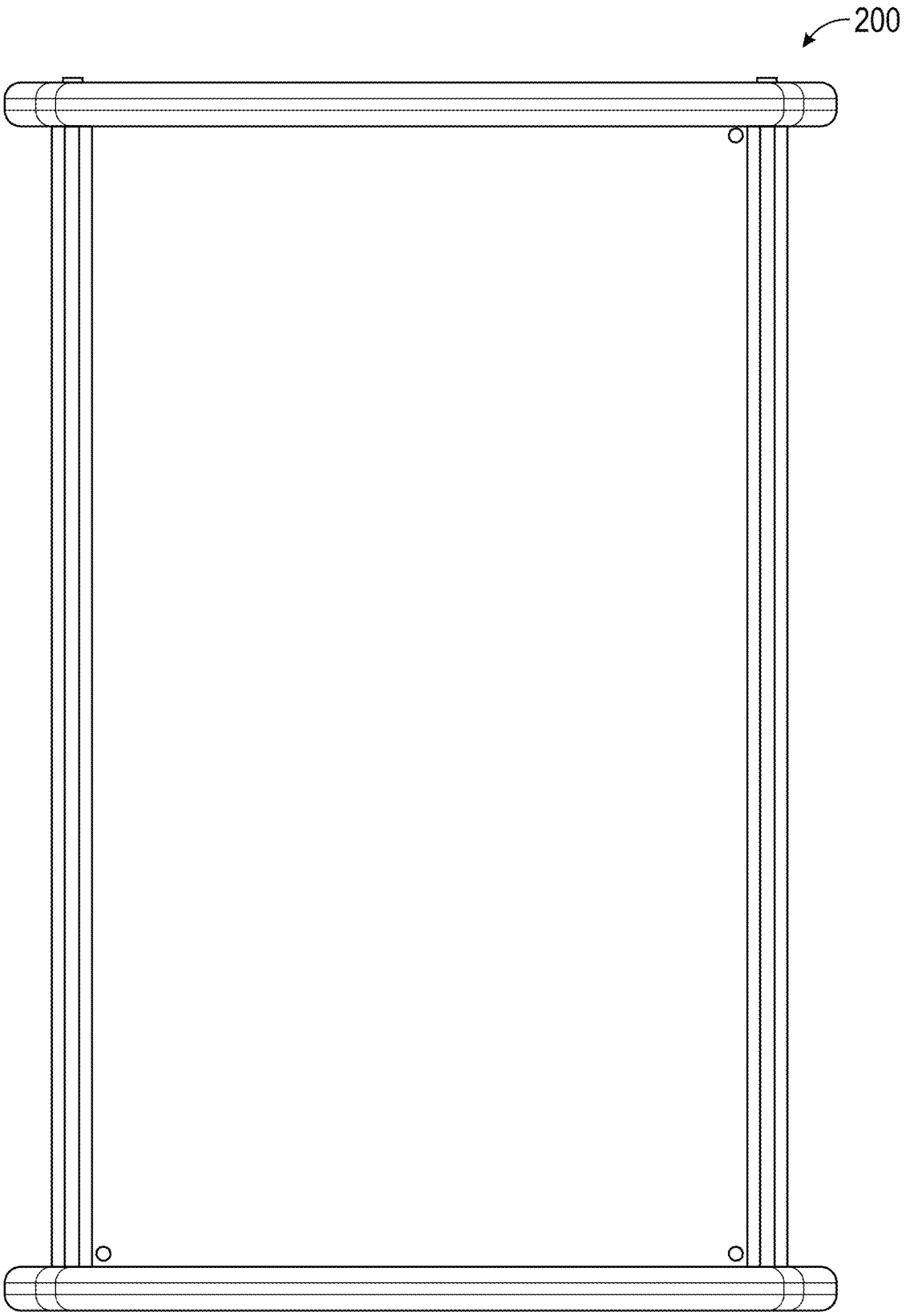
FIG. 35 shows a top view of the crib of FIG. 1B, according to an example embodiment of the present invention.
Figure 36:
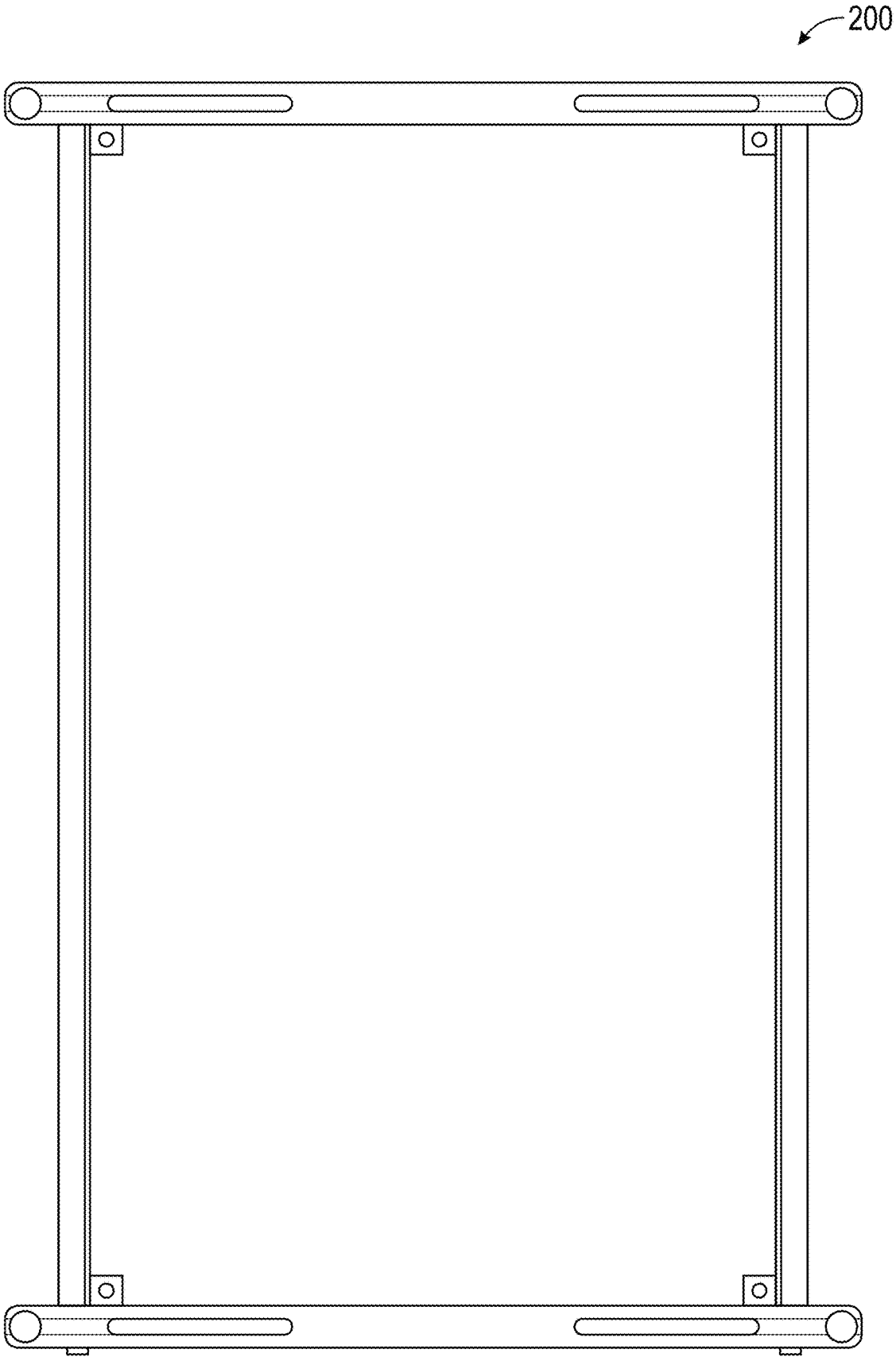
FIG. 36 shows a bottom view of the crib of FIG. 1B, according to an example embodiment of the present invention.

FIGS. 33-39 are additional views of the crib 200 of FIG. 1B, according to an example embodiment of the present disclosure. FIG. 37 illustrates the crib 200 with the breathable material while FIG. 33 illustrates the crib 200 without the breathable material. Likewise, FIG. 38 illustrates the crib 200 with the breathable material while FIG. 34 illustrates the crib 200 without the breathable material.

In some embodiments, the mesh material may have functional properties. Accordingly, in some embodiments, the crib may comprise a functional fabric having air permeability of between 385 CFM and 1530 CFM, a light permeability of between 47 and 99%, and a $CO_2$ rebreathing value of less than 20%. The functional fabric may at least partially blocks a hazard from penetrating the crib. Such hazard may be any hazard now known or later discovered to be hazardous to an infant including, but not limited to, mold, mildew, allergens, heat, ultraviolet light (UV), and electric and magnetic forces (EMF). In other embodiments, the functional fabric may at least partially block any undesirable element from penetrating the crib, regardless of whether such element poses a hazard. This may be provided by, for example, applying a functional coating to the material or adding a functional threading through the material.

Further, for example, the breathable material, when used alone, or in combination with one or more additional layers, may form a breathable material that has a suffocation resistance level of less than about 15 cm $H_2O$, and preferably less than about 5 cm $H_2O$. Suffocation resistance as referred to herein may be determined according to the RAM Consulting Virtual Child Suffocation Hazard Assessment Model, which is a physical model and testing methodology that quantitatively assesses the potential suffocation hazards posed by various types of materials. The details of this model are available from RAM Consulting (Oak Brook, Ill.). Further, according to this model, Z-values are determined that are statistical measurement tools that describe and predict product performance in relation to its specification limit (e.g., such as those described below). For example, the suffocation resistance limit of 5 cm $H_2O$ is an upper specification limit for materials or products that foreseeably are used and/or intended for young infants with high accessibility; and further, the suffocation resistance limit of about 15 cm $H_2O$ is an upper specification limit for other materials or products (e.g., those for toddlers). A Z-value of 4.0 or greater with the corresponding upper specification limit for each applicable testing technique is required for a product to be classified as a very low suffocation risk. The details regarding the determination of Z-values are available from RAM Consulting (Oak Brook, Ill.).

In many embodiments, the crib is configured to provide breathable material throughout the crib such that the head of an infant lying in the crib is exposed to mainly breathable material. The breathable material may include any suitable material that provides breathable functionality such as an open weave material, a mesh type material, or a material having openings smaller than a baby's fingers or toes. Breathable functionality refers to the ability of the material to allow air to move effectively there through. As used herein, when air is indicated as moving effectively through a material, it is meant that the material includes openings (e.g., mesh openings, open-framework, spaces between elements thereof, or even those that may not be visually perceivable openings but still allow a breathable function to occur) that do not impede air movement to an extent that would prevent a human being from breathing through (e.g., when a human's respiratory openings (e.g., nose/mouth) are in direct contact with a material) such a material in order to help prevent suffocation and further that such openings are too small to permit an infant to insert a finger or toe there through. For example, such materials may include cotton, silk, polyester, nylon, modal/semi-cellulose based fabrics, etc.

In one embodiment, the mesh-type material may include a mesh available from Apex Mills, Inc. under the trade designation TAI Mesh. However, other various similar mesh materials (e.g., mesh material having suitable openings) are available. A Suffocation Hazard Assessment was performed by RAM Consulting (Oak Brook, Ill.) (e.g., the Assessment is further described herein and for which protocol is available from RAM Consulting) on the TAI Mesh resulting in average readings of 1.6 cm $H_2O$ and, for an upper specification limit of 5 cm $H_2O$, a Z-value of 9.0 was obtained.

In one example embodiment, the breathable material is a breathable padded mesh-type material (e.g., a padded spacer mesh). Of course, other breathable materials can be used including a single layer mesh. The meshes or other fabrics shown may include designs on the mesh. The meshes or other fabrics may also include a variety of mesh designs and types. It will be recognized that the thickness of the padded mesh material may vary, as well as for other materials described herein. For example, more padding may create a softer more plush effect with slightly different breathability/ventilation properties and more opaqueness (e.g., less light transmissive) whereas less padding may create more breathability and buoyancy with less opaqueness (e.g., more light transmissive). Preferably, the panels described herein are at least somewhat transparent such that at least motion of the child in the crib can be seen.

The breathable material may be a woven polymeric fiber mesh material that is integrated with or attached to a front and/or back substructure. The front substructure may include larger openings on the front substructure than on the back substructure. In one example embodiment, the padded mesh material may be integrated with or attached to the front and back substructures by weaving the fibers that are provided as part of the pile substructure through the front and back substructure. In another embodiment, the breathable material may be integrated by sewing, or otherwise attaching, the padded mesh material between a front and back substructure or other substructures. That is, in this embodiment the padded mesh material is integrated by attaching to other materials, such as breathable materials or pad materials, to form a multi-layer structure. The multi-layer structure may be, for example, laminated or quilted.

In one embodiment, for example, the breathable padded mesh material may include a padded spacer mesh available from Apex Mills, Inc. under the trade designation DNB27 Spacer Mesh. However, other various similar padded spacer mesh materials are available.

In another embodiment, the mesh-type material is a breathable padded mesh material in combination with one or more other material layers. For example, the breathable padded mesh material may be used in combination with one or more layers of other material adjacent to (e.g., one material laid flat against the other) either the front substructure and/or back substructure of the breathable padded mesh material. In various embodiments of such a combination, one or more layers of material may be used adjacent the front substructure, one or more layers of material may be used adjacent the back substructure, or one or more layers of material may be used adjacent the front substructure and the back substructure. For example, such additional layers may be layers of cotton material, knit jersey material, etc. Such additional material layers may provide additional benefits such as, for example, thermal properties with breathability.

Further, for example, the breathable material when used alone, or in combination with one or more additional layers, may be a breathable material (e.g., a breathable padded mesh material, such as a spacer mesh) that has a suffocation resistance level of less than about 15 cm H.sub.2O, and preferably less than about 5 cm $H_2O$. Such a suffocation resistance is determined according to the RAM Consulting Virtual Child Suffocation Hazard Assessment Model which is a physical model and testing methodology that quantitatively assesses the potential suffocation hazards posed by various types of materials. The details of this Model are available from RAM Consulting (Oak Brook, Ill.). Further, according to this Model, Z-values are determined that are statistical measurement tools that describe and predict product performance in relation to its specification limit (e.g., such as those described below). For example, the suffocation resistance limit of 5 cm H.sub.2O is an upper specification limit for materials or products that foreseeably are used and/or intended for young infants with high accessibility; and further, the suffocation resistance limit of about 15 cm $H_2O$ is an upper specification limit for other materials or products (e.g., those for toddlers). A Z-value of 4.0 or greater with the corresponding upper specification limit for each applicable testing technique is required for a product to be classified as a very low suffocation risk. The details regarding the determination of Z-values are available from RAM Consulting (Oak Brook, Ill.).

Suffocation Hazard Assessment was performed by RAM Consulting (Oak Brook, Ill.) on various configurations using the breathable padded mesh material available from Apex Mills, Inc. under the trade designation DNB27 Spacer Mesh.

1 Configuration 1: Single Layer of Padded Spacer Mesh Configuration 2: Layer 1: Padded Spacer Mesh Layer 2: Cotton Configuration 3: Layer 1: Knit Jersey Layer 2: Padded Spacer Mesh Layer 3: Cotton Configuration 4: Layer 1: Cotton Layer 2: Padded Spacer Mesh Layer 3: Cotton Configuration 5: Layer 1: Knit Jersey Layer 2: Padded Spacer Mesh Layer 3: Knit Jersey Configuration 6: Layer 1: Padded Spacer Mesh Layer 2: Flannel Fabrics tested: Knit Jersey Manufacturer: NATEX Content: 50% Polyester/50% Cotton Knit Jersey Style #: INT Cotton Manufacturer: SOUTHERN BELLE Content: 100% Cotton Style #: L93N67 Flannel Manufacturer: QUILTERS CORNER Content: 100% Cotton Style #: RN41324.

A screening was performed on all configurations in both a dry and wet state. The spacer padded mesh when layered with fabrics resulted in a satisfactory reading based on values in cm $H_2O$, wherein the specification upper limit for products young children are intended to lie on is equal to 5 cm $H_2O$ (e.g., mattress pads or items young infants are intended to have their face on) and wherein the specification for products young children are not intended to lie on is equal to 15 cm $H_2O$.

Four individual readings were performed with an average being determined. Dry state readings did not register, thus presenting very low hazard when the configurations were dry (i.e., under the 5 cm $H_2O$ specification limit). In the wet state (after application of 8 ml of sprayed on water), the average readings for the configurations were between 4.6 cm $H_2O$ and 6.2 cm $H_2O$.

For the individual single layer of spacer padded mesh, average readings of 1.7 cm $H_2O$ were taken. Further, for an upper specification limit of 5 cm $H_2O$, a Z-value of 9.5 was obtained.

The air permeability of breathable materials may allow the breathable material to be layered with other breathable material to create a layered breathable material, while still maintaining air permeability (CFM).

Testing was conducted by Bureau Veritas in accordance with ASTM D737 standards to determine the air permeability (CFM) of a single layer of textile materials. Additionally, various combinations of layered materials were also tested to determine air permeability. For example, a single layer of breathable material with a thickness of 0.13 inches provided an air permeability of 1013.1 CFM. Adjusting the properties (e.g., thickness, weave pattern, etc.) of the single layer of a breathable material may allow the air permeability to achieve an air permeability of at least 1250 CFM. Adjusting the properties (e.g., thickness, weave pattern, etc.) of the layered breathable material may allow the air permeability to achieve an air permeability of at least 900 CFM.

The breathability of the breathable material 114 of crib 100 can be measured using a variety of methodologies, including air permeability, mesh coverage (both location and cover factor measurement via light microscopy), light permeability as measured by photodetector, spectrophotometer or by transmittance or blocking of ultraviolet radiation, or other suitable tests. Preferably, the breathable material 114 has an air permeability of between 385 CFM to 1530 CFM. Of course, the higher the air permeability the more breathable the material is. Preferably, the breathable material 114 has a mesh coverage of between 32% and 91%. Mesh coverage is measure of the holes versus material in a mesh material. Preferably, the breathable material 114 has a light permeability by photodetector of between 47% and 99%, by spectrophotometer of between 4 and 71%, and by ultraviolet radiation of between 47% and 100%. The tested samples may have one or more layers that compose the breathable material 114 and may or may not be "padded". The below chart illustrates tests performed on various samples of materials that could comprise the breathable material 114:

| Sample | Air Permeability - Air Permeability of Textile Materials | Mesh Coverage - Location of Mesh | Mesh Coverage - Cover Factor Measurement via Light Microscopy | Light Permeability - Light Blocking Effect of Curtain Materials, Photodetector Method | Light Permeability - Light Blocking Via Spectrophotometer | Light Permeability - Transmittance or Blocking of Erythemally Weighted Ultraviolet Radiation Through Fabrics |
|---|---|---|---|---|---|---|
| Sample 1 | 1,013.1 CFM | 11" total height 2" poly trim (1" at top, 1" at bottom) 9" mesh | Facing in - 47% coverage Facing out - 40% coverage | Facing in - 86.37% avg % of light blocked Facing out - 86.84% avg % of light blocked | Facing in - 48.60% avg light transmission Facing out - 49.09% avg light transmission | Facing in - UPF rating 10; blocked 87.78% UVA rays and 91.46% UVB rays Facing out - UPF rating 10; blocked 86.41% UVA rays and 91.69% UVB rays |
| Sample 2 | 1,013.1 CFM | 11" total height 2" poly trim (1" at top, 1" at bottom) 9" mesh | Facing in - 39% coverage Facing out - 32% coverage | Facing in - 87.73% avg % of light blocked Facing out - 88.26% avg % of light blocked | Facing in - 12.67% avg light transmission Facing out - 11.99% avg light transmission | Facing in - UPF rating 10; blocked 86.56% UVA rays and 91.70% UVB rays Facing out) -- UPF rating 10; blocked 88.64% UVA rays and 92.45% UVB rays |
| Sample 3 | 536.6 CFM | 11" total height 2" poly trim (1" at top, 1" at bottom) 9" mesh | Facing in - 50% Coverage Facing out -- 43% coverage | Facing in - 97.58% avg % of light blocked Facing out - 97.75% avg % of light blocked | Facing in - 24.83% avg light transmission Facing out - 22.90% avg light transmission | Facing in - UPF rating 50+; blocked 98.76% UVA rays and 99.37% UVB rays Facing out -- UPF rating 50+; blocked 98.71% UVA rays and 99.33% UVB rays |
| Sample 4 | 536.6 CFM | 11" total height 2" poly trim (1" at top, 1" at bottom) 9" mesh | Facing in - 44% Coverage Facing out - 49% coverage | Facing in - 98.50% avg % of light blocked Facing out - 98.44% avg % of light blocked | Facing in - 4.01% avg light transmission Facing out - 5.09% avg light transmission | Facing in - UPF rating 50+; blocked 98.56% UVA rays and 99.01% UVB rays Facing out - UPF rating 10; blocked 98.59% UVA rays and 98.96% UVB rays |
| Sample 5 | 520.5 CFM | 11" total height 2" poly trim (1" at top, 1 " at bottom) 9" mesh | Facing in - 52% Coverage Facing out - 49% coverage | Facing in - 97.57% avg % of light blocked Facing out - 97.59% avg % of light blocked | Facing in - 27.03% avg light transmission Facing out - 25.66% avg light transmission | Facing in - UPF rating 50+; blocked 97.88% UVA rays and 99.01% UVB rays Facing out - UPF rating 50+; blocked 98.01% UVA and 99.08% UVB rays |
| Sample 6 | 384.6 CFM | 11" total height 2" poly trim (1" at top, 1" at bottom) 9" mesh | Facing in - 51% Coverage Facing out - 50% coverage | Facing in - 99.18% avg % of light blocked Facing out - 99.20% avg % of light blocked | Facing in - 12.25% avg light transmission Facing out - 10.44% avg light transmission | Facing in - UPF rating 50+; blocked 99.91% UVA rays and 99.89% UVB rays Facing out - UPF rating 50+; blocked 99.89% UVA rays and 99.97% UVB rays |
| Sample 7 | 547.6 CFM | 14" total height 4" poly trim (3" at top, 1" at bottom) 10" mesh | Facing in - 80% Coverage Facing out - 80% coverage | Facing in - 80.87% avg % of light blocked Facing out - 81.47% avg % of light blocked | Facing in - 45.32% avg light transmission Facing out - 45.43% avg light transmission | Facing in - UPF rating 5; blocked 76.91% UVA rays and 82.06% UVB rays Facing out - UPF rating 50+; blocked 77.24% UVA rays and 82.29% UVB rays |

-continued

| Sample | Air Permeability - Air Permeability of Textile Materials | Mesh Coverage - Location of Mesh | Mesh Coverage - Cover Factor Measurement via Light Microscopy | Light Permeability - Light Blocking Effect of Curtain Materials, Photodetector Method | Light Permeability - Light Blocking Via Spectrophotometer | Light Permeability - Transmittance or Blocking of Erythemally Weighted Ultraviolet Radiation Through Fabrics |
|---|---|---|---|---|---|---|
| Sample 8 | 855 CFM | 11" total height 2" poly trim (1" at top, 1" at bottom) 9" mesh | Facing in - 91% Coverage Facing out - 92% coverage | Facing in - 82.46% avg % of light blocked Facing out - 81.50% avg % of light blocked | Facing in - 57.21% avg light transmission Facing out - 52.48% avg light transmission | Facing in - UPF rating 5; blocked 75.61% UVA rays and 87.58% UVB rays Facing out - UPF rating 0; blocked 77.17% UVA rays and 85.63% UVB rays |
| Sample 9 | 730 CFM | 11" total height 2" poly trim (1" at top, 1" at bottom) 9" mesh | Facing in - 61% Coverage Facing out - 62% coverage | Facing in - 89.64% avg % of light blocked Facing out - 89.67% avg % of light blocked | Facing in - 34.20% avg light transmission Facing out - 38.01% avg light transmission | Facing in - UPF rating 10; blocked 90.87% UVA rays and 92.28% UVB rays Facing out - UPF rating 0; blocked 90.80% UVA rays and 92.79% UVB rays |
| Sample 10 | 929 CFM | 11" total height 2" poly trim (1" at top, 1" at bottom) 9" mesh | Facing in - 86% Coverage Facing out - 86% coverage | Facing in - 79.85% avg % of light blocked Facing out - 80.36% avg % of light blocked | Facing in - 46.39% avg light transmission Facing out - 57.03% avg light transmission | Facing in - UPF rating 5; blocked 65.89% UVA rays and 82.85% UVB rays Facing out - UPF rating 0; blocked 63.69% UVA rays and 80.86% UVB rays |
| Sample 11 | 530 CFM | 11" total height 2" poly trim (1" at top, 1" at bottom) 9" mesh | Facing in - 71% Coverage Facing out) - 39% coverage | Facing in - 90.74% avg % of light blocked Facing out - 90.39% avg % of light blocked | Facing in) - 43.14% avg light transmission Facing out) - 43.96% avg light transmission | Facing in) - UPF rating 10; blocked 81.66% UVA rays and 94.13% UVB rays Facing out) - UPF rating 10; blocked 81.35% UVA rays and 93.77% UVB rays |
| Sample 12 | 760 CFM | 11" total height 2" poly trim (1" at top, 1" at bottom) 9" mesh | Facing in - 53% Coverage Facing out - 71% coverage | Facing in - 94.40% avg % of light blocked Facing out - 94.99% avg % of light blocked | Facing in - 9.21% avg light transmission Facing out) - 10.00% avg light transmission | Facing in - UPF rating 25; blocked 92.74% UVA rays and 96.01% UVB rays Facing out - UPF rating 20; blocked 92.59% UVA rays and 95.77% UVB rays |
| Sample 13 | 650 CFM | 11" total height 2" poly trim (1" at top, 1" at bottom) 9" mesh | Facing in - 61% Coverage Facing out - 50% coverage | Facing in - 91.84% avg % of light blocked Facing out - 92.15% avg % of light blocked | Facing in - 35.96% avg light transmission Facing out - 37.24% avg light transmission | Facing in - UPF rating 15; blocked 91.76% UVA rays and 93.80% UVB rays Facing out - UPF rating 15; blocked 92.15% UVA rays and 94.21% UVB rays |
| Sample 14 | 1530 CFM | 10" total height 6" poly trim (5" at top, 1" at bottom) 4" mesh | Facing in - 51% Coverage Facing out - 51% coverage | Facing in - 47.03% avg % of light blocked Facing out - 47.87% avg % of light blocked | Facing in - 70.60% avg light transmission Facing out - 66.37% avg light transmission | Facing in - UPF rating 0; blocked 47.63% UVA rays and 49.00% UVB rays Facing out - UPF rating 0; blocked 47.24% UVA rays and 48.71% UVB rays |

The breathable materials allow for air circulation. When a padded, soft breathable mesh material is utilized, further protection is provided to a child from bodily harm. When using one or more of the breathable mesh materials described herein, it is preferred that little rebreathing of carbon dioxide occur when a child's face is in direct contact with the material.

One skilled in the art will recognize that various types of padding may be used in addition to the breathable material in order to form one or more of the shapes of the objects previously described herein. Further, for example, such padding materials may be the breathable padded mesh material itself and/or other breathable materials, such as cotton, jersey, flannel, polyester, nylon, rayon, gabardine, terry cloth, etc.

The preceding described embodiments are illustrative of the practice of the invention. It is to be understood, therefore, that other expedients known to those skilled in the art or disclosed herein may be employed without departing from the invention or the scope of the appended claims. For example, various apparatus or steps of one embodiment described herein may be used with one or more other embodiments described herein to form various combinations of methods, systems, or apparatus contemplated by the present invention. As such, the present invention includes within its scope other methods, systems and apparatus for implementing and using the invention described herein.

What is claimed is:

1. A crib comprising:

a first side;

a second side opposite the first side;

a third side, the third side including a third side structural support system comprising a top portion and a bottom portion;

a third side breathable material extending between the first side and the second side on the third side;

a third side lateral support member extending along and proximate to the third side;

a fourth side opposite the third side, the fourth side including a fourth side structural support system comprising a top portion and a bottom portion;

a fourth side breathable material extending between the first side and the second side on the fourth side;

a fourth side lateral support member extending along and proximate to the fourth side;

a solid mattress platform extending between the first and second sides and between the third and fourth sides, the mattress platform being movable between a first position and a second position lower than the first position;

wherein at both the first position and the second position, the third side lateral support member is positioned closer to the top portion of the third side structural support system than to the bottom portion of the third side structural support system;

wherein the first side, the second side, the third side, the fourth side, and the solid mattress platform define an interior space.

2. The crib of claim 1, wherein the third side lateral support member and the fourth side lateral support member are provided in the interior space of the crib.

3. The crib of claim 1, wherein the third side lateral support member is provided along the third side breathable material opposite the interior space of the crib and the fourth third side lateral support member is provided along the third side breathable material opposite the interior space of the crib.

4. The crib of claim 3, wherein the third side breathable material is between the solid mattress platform and the third side lateral support member, and the fourth side breathable material is between the solid mattress platform and the fourth side lateral support member.

5. The crib of claim 1, wherein the third side lateral support member and the fourth side lateral support member are fixed in position.

6. The crib of claim 1, wherein the first side and the second side are solid.

7. The crib of claim 1, further comprising a first side breathable material extending between the third side and the fourth side on the first side; and a second side breathable material extending between the third side and the fourth side on the second side.

8. The crib of claim 7, wherein the first side includes a first side structural support system comprising a top portion and a bottom portion, and the second side includes a second side structural support system comprising a top portion and a bottom portion.

9. The crib of claim 8, wherein each of the first side structural support system, the second side structural support system, the third side structural support system, the fourth side structural support system further includes a first side portion and a second side portion.

10. The crib of claim 1, wherein each of the third side structural support system and the fourth side structural support system further comprises a first side portion and a second side portion, wherein the third side breathable material extends from the first side portion to the second side portion of the third side structural support system, and wherein the fourth side breathable material extends from the first side portion to the second side portion of the fourth side structural support system.

11. The crib of claim 1, wherein the first position of the solid mattress platform is in line with the third side lateral support member and the fourth side lateral support member, and the second position of the solid mattress platform is proximate the bottom portion of the third side structural support system and the bottom portion of the fourth side structural support system.

12. The crib of claim 1, wherein the mattress platform is secured to at least two of the first side, the second side, the third side, and the fourth side.

13. The crib of claim 1, wherein the solid mattress platform comprises first, second, third, and fourth frame elements and a mattress support retained by the first, second, third, and fourth frame elements.

14. The crib of claim 1, wherein each breathable material comprises a mesh-type material having a mesh coverage of between 32% and 91%.

15. The crib of claim 1, wherein each breathable material has an air permeability of between 385 CFM to 1530 CFM and a light permeability of between 47 and 99%.

16. A crib comprising:

a first side, the first side including a first side structural support system comprising a top portion and a bottom portion;

a second side opposite the first side, the second side including a second side structural support system comprising a top portion and a bottom portion;

a third side, the third side including a third side structural support system comprising a top portion and a bottom portion;

a third side lateral support member extending along and proximate to the third side;

a fourth side opposite the third side, the fourth side including a fourth side structural support system comprising a top portion and a bottom portion;

a fourth side lateral support member extending along and proximate to the fourth side;

a first side breathable material extending between the third side and the fourth side on the first side;

a second side breathable material extending between the third side and the fourth side on the second side;

a third side breathable material extending between the first side and the second side on the third side;

a fourth side breathable material extending between the first side and the second side on the fourth side;

a solid mattress platform extending between the first and second sides and between the third and fourth sides, the mattress platform being movable between a first position and a second position lower than the first position;

at the first position, the mattress platform is positioned closer to the top portion of the third side structural support system than to the bottom portion of the third side structural support system;

wherein the first side, the second side, the third side, the fourth side, and the solid mattress platform define an interior space;

wherein the third side lateral support member is provided along the third side breathable material opposite the interior space of the crib and the fourth third side lateral support member is provided along the third side breathable material opposite the interior space of the crib.

17. The crib of claim 16, wherein each breathable material comprises a mesh-type material having a mesh coverage of between 32% and 91%.

18. A crib comprising:

a first side, wherein the first side is solid;

a second side opposite the first side, wherein the second side is solid;

a third side, the third side including a third side structural support system comprising a top portion and a bottom portion;

a third side breathable material extending between the first side and the second side on the third side;

a fourth side opposite the third side, the fourth side including a fourth side structural support system comprising a top portion and a bottom portion;

a fourth side breathable material extending between the first side and the second side on the fourth side;

a solid mattress platform extending between the first and second sides and between the third and fourth sides;

wherein the first side, the second side, the third side, the fourth side, and the solid mattress platform define an interior space;

a third side lateral support member extending along and proximate to the third side, wherein the third side lateral support member is fixed and not adjustable in height;

a fourth side lateral support member extending along and proximate to the fourth side;

wherein an area of the third side breathable material between the top portion of the third side structural support system and the third side lateral support member is less than an area of the third side breathable material between the bottom portion of the third side structural support system and the third side lateral support member;

wherein the third side lateral support member is provided along the third side breathable material opposite the interior space of the crib such that the third side breathable material is provided between the third side lateral support member and the solid mattress platform, and the fourth third side lateral support member is provided along the third side breathable material opposite the interior space of the crib such that the third side breathable material is provided between the third side lateral support member and the solid mattress platform.

19. The crib of claim 18, wherein each breathable material comprises a mesh-type material having a mesh coverage of between 32% and 91%.

20. The crib of claim 19, wherein each of the third side structural support system and the fourth side structural support system further includes a first side portion and a second side portion, wherein the third side lateral support member extends from the third side first side portion to the third side second side portion and the fourth side lateral support member extends from the third side first side portion to the fourth side second side portion.

* * * * *